US006439487B1

(12) United States Patent
Anderson et al.

(10) Patent No.: US 6,439,487 B1
(45) Date of Patent: Aug. 27, 2002

(54) GRINDING MECHANISM FOR A FOOD WASTE DISPOSER AND METHOD OF MAKING THE GRINDING MECHANISM

(75) Inventors: Scott W. Anderson; David W. Barke, both of Racine; Paul W. Boske, Caledonia; Timothy W. Kolloch, Kenosha, all of WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/524,853

(22) Filed: Mar. 14, 2000

(51) Int. Cl.[7] ..... B02C 23/36
(52) U.S. Cl. ..... 241/46.013; 241/46.017; 241/46.08
(58) Field of Search ..... 241/46.013, 46.014, 241/46.015, 46.016, 46.017, 46.06, 46.08

(56) References Cited

U.S. PATENT DOCUMENTS

| | | | |
|---|---|---|---|
| 1,174,656 | A | 3/1916 | Beckwith |
| 1,459,713 | A | 6/1923 | Beggs |
| 1,965,033 | A | 7/1934 | Dillon |
| 2,004,737 | A | 6/1935 | Tonks |
| 2,012,680 | A | 8/1935 | Hammes |

(List continued on next page.)

OTHER PUBLICATIONS

Photographs of Grinding Plate by Parkamatic (Top View and Bottom View).
Photographs of Grinding Plate by In–Sink–Erator (Top View and Bottom View) (about 1960).
Photographs of Grinding Plate by In–Sink–Erator (Top View and Bottom View) (about 1968).
Photographs of Grinding Plate by In–Sink–Erator (Top View and Bottom View) (about 1970).
Photographs of Grinding Plate by Hush Master Waste King (Top Views and Bottom View).
Photographs of Grinding Plate by Modern Air Cyclone Corp. (Top View and Bottom View).

*Primary Examiner*—Mark Rosenbaum
(74) *Attorney, Agent, or Firm*—Howrey, Simon, Arnold & White, LLP

(57) ABSTRACT

A grinding mechanism or assembly for a food waste disposer, the grinding mechanism being enclosed in a housing of the food waste disposer. The grinding mechanism includes a shredder plate assembly and a stationary shredder ring. The shredder plate assembly has an upper rotating plate and a lower lug support plate. The lower lug support plate has a body portion, and shredder lugs and tumbling spikes integrally formed with the body portion. The upper rotating plate has key slots and key holes for receiving the fixed shredder lugs and tumbling spikes. The stationary shredder ring is fixed to the housing of the food waste disposer and has a plurality of teeth. The stationary shredder ring may also have diverters and breakers. The fixed shredder lugs force food waste against the teeth of the stationary shredder ring to grind the food waste into particulate matter. The profile of the fixed shredder lug may include a vertical toe, a notch and a heel. The heel has a slope that decreases inwardly toward the center of the lower lug support plate. The shredder plate assembly and stationary shredder ring may be formed by stamping methods, by powdered metal methods, by injection molding methods, or by casting methods. The shredder plate assembly may also be formed as one unitary component having a rotating plate, fixed shredder lugs and tumbling spikes. The present invention also includes a method of manufacturing a food waste disposer that has a grinding mechanism. The method includes the steps of forming an upper rotating plate, forming a lower lug support plate, and assembling a shredder plate assembly from the upper rotating plate and the lower support plate. The method further includes the steps of forming a stationary shredder ring, providing an enclosure, and attaching the stationary shredder ring to the enclosure. Additionally, the method includes providing a motor for imparting rotational movement to a motor shaft and mounting the shredder plate assembly to the motor shaft. The enclosure is positioned to encompass the grinding mechanism.

54 Claims, 15 Drawing Sheets

U.S. PATENT DOCUMENTS

| | | | |
|---|---|---|---|
| 2,044,563 | A | 6/1936 | Carter |
| 2,044,564 | A | 6/1936 | Carter |
| 2,225,171 | A | 12/1940 | Hammes |
| 3,025,117 | A | 3/1962 | Weiczorek |
| 3,589,624 | A | 6/1971 | Smith |
| 3,804,341 | A | 4/1974 | Guth |
| 3,862,720 | A | 1/1975 | Guth |
| 3,875,462 | A | 4/1975 | Kiefer et al. |
| 4,128,210 | A | 12/1978 | Brenner et al. |
| 4,134,555 | A | 1/1979 | Rosselet |
| 4,573,642 | A | 3/1986 | Spelber |
| 4,776,523 | A | 10/1988 | Hurst |
| 4,917,311 | A | 4/1990 | Yoshino et al. |
| 5,129,590 | A | 7/1992 | Shinya |
| 5,340,036 | A | 8/1994 | Riley |
| 5,533,681 | A | 7/1996 | Riley |
| 6,007,006 | A | 12/1999 | Engel et al. |

GRINDING MECHANISM FOR A FOOD WASTE DISPOSER AND METHOD OF MAKING THE GRINDING MECHANISM

FIELD OF THE INVENTION

The present invention relates generally to food waste disposers and, more particularly, to a grinding mechanism or assembly for a food waste disposer.

BACKGROUND OF THE INVENTION

Although food waste disposers are widely available, manufacturers continue to optimize the grinding operation of such disposers. To perform the grinding operation, conventional disposers typically include a rotating grind plate. The rotating grind plate has grinding lugs attached to the plate. The food waste delivered to the rotating grind plate is forced by the grinding lugs against a stationary shredder ring. The stationary shredder ring has teeth that grind the food waste into particulate matter sufficiently small to pass from above the rotating plate to below the grinding plate via gaps between the teeth outside the periphery of the rotating plate. The particulate matter then passes to a discharge outlet and into the drain pipe.

The fineness and speed of the grind are important considerations in designing the grinding mechanism for a disposer. A manufacturer must consider the demands of a wide variety of food waste with varying properties (i.e., soft, hard, stringy, leafy, and resilient). The types of food waste have changed over the years. Due to healthier diets, consumers tend to eat more fruits and vegetables. This results in food waste having a soft, stringy, leafy, and resilient consistency. Additionally, the modern diet increased the use of white meat. The waste from meat is typically bone. Although the bones from white meat are typically not as durable or difficult to grind than bones from red meat, the bones from white meat tend to splinter. The grinding mechanism must be adequate for all types of food waste.

The type and geometry of the grinding lugs affect the fineness and speed of the grind. Grinding lugs may either be stationary (fixed lugs) or free to rotate (swivel lugs). Early food waste disposers used fixed lugs One example of a disposer with fixed lugs is disclosed in U.S. Pat. No. 4,128,210 (Brenner et al.). There, a fixed impeller or lug extends upwardly and is rigidly attached to the rotating grinding plate. The geometry of the fixed impeller or lug includes a series of steps. The steps rise inwardly toward the center of the rotating grinding plate. Another example of a disposer with fixed lugs is disclosed in U.S. Pat. No. 5,340,036 (Riley), which is owned by the assignee of the present application. There, fixed impellers or lugs are used in a dry waste disposer. In one embodiment, the geometry of the fixed grinding impeller or lug is sloped where the slope rises or increases inwardly toward the center of the rotating grinding plate. In other embodiments, the geometry of the fixed grinding impeller or lug is in a z-shaped or c-shaped configuration. A further embodiment includes a flat grinding impeller or lug. Again, the impeller or lug is rigidly fixed to the rotating plate.

Today, disposers typically use swivel lugs. A food waste disposer having swivel lugs is disclosed in U.S. Pat. No. 6,007,006 (Engel et al.), which is owned by the assignee of the present application and incorporated herein by reference in its entirety. The disposer may be mounted in a well-known manner in the drain opening of a sink using mounting members of the type disclosed in U.S. Pat. No. 3,025,007 (Weiczorek), which is owned by the assignee of the present application and also incorporated herein by reference in its entirety.

As shown in FIG. 1, a conventional disposer includes an upper food conveying section 20, a lower motor section 22, and a central grinding section 24 disposed between the food conveying section 20 and the motor section 22. The food conveying section 20 includes a housing 26 that forms an inlet 28 at its upper end for receiving food waste and water. The housing 26 also forms an inlet 30 for passing water discharged from a dishwasher (not shown). The housing 26 has diverters 96 that are shaped to points 97. The food conveying section 20 conveys the food waste to the central grinding section 24. The motor section 22 includes an induction motor 32 imparting rotational movement to a motor shaft 34. The motor 32 is enclosed within a motor housing 36 having an upper end frame 38, a metal lower end frame 40, and a bent metal stator band 42 extending between the upper and lower end frames 38 and 40.

The grinding section 24 shows a typical grinding plate with swivel lugs. The swivel lug grind system in FIG. 1 has a circular rotating plate or disc 48, a pair of swivel lugs 72, and a stationary shredder ring 46. The plate 48 is mounted to the motor shaft 34 of the motor section 22. The swivel lugs 72 are fastened to the plate 48, but are free to rotate relative to the rotating plate 48. The grinding section 24 includes a housing 52. The housings 26 and 52 are fastened to the lower end frame 40 by a plurality of bolts 54.

As shown in FIGS. 2 and 3, the shredder ring 46, which includes a plurality of spaced teeth 58, is fixedly attached to an inner surface of the housing 52. In the operation of the food waste disposer, the food waste delivered by the food conveying section 22 to the grinding section 24 is forced by the swivel lugs 72 against the teeth 58 of the shredder ring 46. The edges of the teeth 58 grind the food waste into particulate matter sufficiently small to pass from above the grinding plate 48 to below the grinding plate 48 via gaps between the teeth 58 outside the periphery of the plate 48. Due to gravity, the particulate matter that passes through the gaps between the teeth 58 drops onto the upper end frame 38 and, along with water injected into the disposer, is discharged through a threaded discharge outlet 98 into a tailpipe 97. As shown in FIG. 1, the tailpipe 97 may be connected to the discharge outlet 98 by an off-the-shelf plumbing nut 99. There are other known ways to connect a food waste disposer to a tailpipe 97 as explained in U.S. Pat. No. 6,007,006 (Engel et al.).

Although the food waste disposer in FIG. 1 operates efficiently and effectively, it has been found, through the present invention, that a fixed lug grind system can provide a finer grind by optimizing the design of the grind elements.

The problem of jamming is another important consideration in designing the grinding operation. Prior food waste disposers with fixed lugs were known for jamming. Jamming occurs when hard objects such as bones or broken pieces of flatware enter the food waste disposer and get stuck between the rotating grinding elements and the stationary shredder ring. In an attempt to resist jams, the prior art tried to increase the rotational speed of the rotating grind elements or capacitor start. This required increasing the horsepower of the motor, however, and resulted in additional costs of the disposer.

Additionally, to resist jams, the prior art attempted to add swivel lugs to the rotating grinding plate. Although the food waste disposer in FIG. 1 with swivel lugs reduces jams, it has been found, through the present invention, that jamming can also be reduced using fixed lugs by modifying the profile of the lugs without increasing horsepower or capacitor start.

The use of swivel lugs has disadvantages. For example, swivel lugs produce a noisier grinding operation. Moreover, the use of swivel lugs creates a problem known as "stuck" lugs. This happens when a food particle (typically a bone fragment or splinter) lodges itself beneath the lug and prevents the lug from moving. A "stuck" lug can cause imbalances, resulting in further noise and a degradation of the grind performance. Additionally, when a swivel lug is "stuck," the food waste is more coarse, which can result in clogged drains.

The use of swivel lugs also increases the chances of "riding." Riding occurs when food particles rotate at the same speed as the grind elements without being ground. Swivel lugs promote riding because they comply to the motion of the food particle without forcing the particle to be comminuted. The prior art has attempted to solve this problem by decreasing shredder lug height, increasing rotational speeds, and modifying the swivel lugs. Although some methods have reduced the chances of riding, the problem has not been eliminated.

Thus, a need exists for a grinding assembly which has the advantages of both a fixed and rotating lug type without disadvantages of either.

SUMMARY OF THE INVENTION

To that end, the present invention provides a grinding mechanism or assembly for a food waste disposer, the grinding mechanism being enclosed in a housing of the food waste disposer. The grinding mechanism includes a shredder plate assembly and a stationary shredder ring. The shredder plate assembly has an upper rotating plate and a lower lug support plate. The lower lug support plate has a body portion and at least one fixed shredder lug integrally formed with the body portion. The upper rotating plate has at least one key slot for receiving the fixed shredder lug. The stationary shredder ring is fixed to the housing of the food waste disposer and has a plurality of teeth. The shredder plate assembly is mounted on a motor shaft that rotates by a motor. The fixed shredder lug forces food waste against the teeth of the stationary shredder ring to grind the food waste into particulate matter.

The profile of the fixed shredder lug may include a vertical toe, a notch and a heel. The heel has a slope that decreases inwardly toward the center of the lower lug support plate. The lower lug support plate may further include at least one fixed tumbling spike integrally formed with the body portion of the lower lug support plate. The fixed tumbling spike assist in the movement of the food waste. The upper rotating plate has a key hole to receive the fixed tumbling spike.

The lower lug support plate may also include a strengthening rib, positive locator, or pumping fingers. The positive locators stabilize the shredder plate assembly and transfer torque from the lower lug support plate to the upper rotating plate. The pumping fingers protrude below the lower lug support plate and may protrude the outer diameter of the lower lug support plate. The pumping fingers improve the fineness of the grind performance as well as increase pumping pressure through a discharge outlet of the food waste disposer.

The upper rotating plate may also include strengthening ribs, drain holes, under-cutters or ramps. The under-cutters protrude beyond the outer diameter of the lower lug support plate and improve the fineness of the grind performance. The ramps are located on the leading edge of the slot that receives the fixed shredder lug and close the void immediately in front of the shredder lug.

The stationary shredder ring may also include diverters and breakers to cause the food waste to tumble, reducing the chances of "riding." The stationary shredder ring may be assembled using a TOX® round joint. The benefit of using a TOX® round joint is that it can act as a breaker for the stationary shredder ring.

The shredder plate assembly and a stationary shredder ring may be formed using stamping methods, powdered metal methods, injection molding methods, or casting methods.

In another embodiment, the present invention is a food waste disposer that includes an upper food conveying section, a lower motor section and a central grinding section. The upper food conveying section has a first housing forming an inlet for receiving food waste. The lower motor section has a motor for imparting rotational movement to a motor shaft. The central grinding section is disposed between the food conveying section and the motor section. The grinding section has a second housing, a shredder plate assembly and a stationary shredder ring. The shredder plate assembly is mounted to the motor shaft and has an upper rotating plate and a lower lug support plate. The stationary shredder ring has a plurality of teeth and is attached to the second housing. The lower lug support plate has a plurality of fixed shredder lugs to force the food waste against the teeth of the stationary shredder ring to grind the food waste into particulate matter.

The first housing may have a dishwasher inlet and a pair of diverters. The diverters may be rounded and/or smooth in shape and located adjacent to the dishwasher inlet. The second housing may form a discharge outlet having a threaded outer surface adapted to threadably engage a threaded inner surface of a plumbing nut to connect a tailpipe to the discharge outlet.

In yet another embodiment, the present invention is a food waste disposer that includes an upper food conveying section, a lower motor section and a central grinding section. The upper food conveying section has a first housing forming an inlet for receiving food waste. The lower motor section has a motor for imparting rotational movement to a motor shaft and a motor housing that encloses the motor. The central grinding section is disposed between the food conveying section and the motor section. The grinding section has a grinding mechanism and a second housing. The grinding mechanism includes a stationary shredder ring and a shredder plate assembly. The stationary shredder ring has a plurality of teeth and is attached to the second housing. The shredder plate assembly is mounted to the motor shaft and has at least one tumbling spike and a plurality of fixed shredder lugs. The tumbling spike assists in the movement of the food waste. The fixed shredder lugs force the food waste against the teeth of the stationary shredder ring to grind the food waste into particulate matter.

In a further embodiment, the present invention is a grinding mechanism for a food waste disposer that is enclosed in a housing of the food waste disposer. The grinding mechanism comprises a shredder plate assembly and a stationary shredder ring. The shredder plate assembly has at least one fixed shredder lug and at least one tumbling spike. The shredder lug has a vertical toe, a notch and a heel. The heel has a slope that decreases inwardly toward the center of the shredder plate assembly. The stationary shredder ring is fixed to the housing of the food waste disposer and has a plurality of teeth. The fixed shredder lug forces the food waste against the teeth of the stationary shredder ring to grind the food waste into particulate matter. The shredder plate assembly may be formed from stamping methods, powdered metal methods, injection molding methods, or casting methods.

In still another embodiment, the present invention includes a method of manufacturing a food waste disposer that has a grinding mechanism. The grinding mechanism has a shredder plate assembly and a stationary shredder ring. The shredder plate assembly includes an upper rotating plate and a lower lug support plate. The method includes the steps of forming the upper rotating plate, forming the lower lug support plate, and assembling the shredder plate assembly from the upper rotating plate and the lower support plate. The method further includes the steps of forming a stationary shredder ring, providing an enclosure, and attaching the stationary shredder ring to the enclosure. Additionally, the method includes providing a motor for imparting rotational movement to a motor shaft and mounting the shredder plate assembly to the motor shaft. The enclosure is positioned to encompass the grinding mechanism.

The step of forming the upper rotating plate and the lower lug support plate may include cold stamping the component from a sheet or strip of metal, although other methods may be used such as powdered metal methods, injection molding methods, and casting methods. The step of forming the lower lug support plate may further include the step of forming a plurality of fixed shredder lugs and tumbling spikes. The lower lug support plate may further be heat treated after the forming step.

The step of forming the stationary shredder ring may include cold stamping the ring from a sheet or strip of metal, although other methods may be used such as powered metal methods, injection molding methods, and casting methods.

The enclosure may include a dishwasher inlet and a plurality of diverters that are rounded and/or smooth in shape. The rounded diverters may be located adjacent to the dishwasher inlet.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings.

Figure 1:
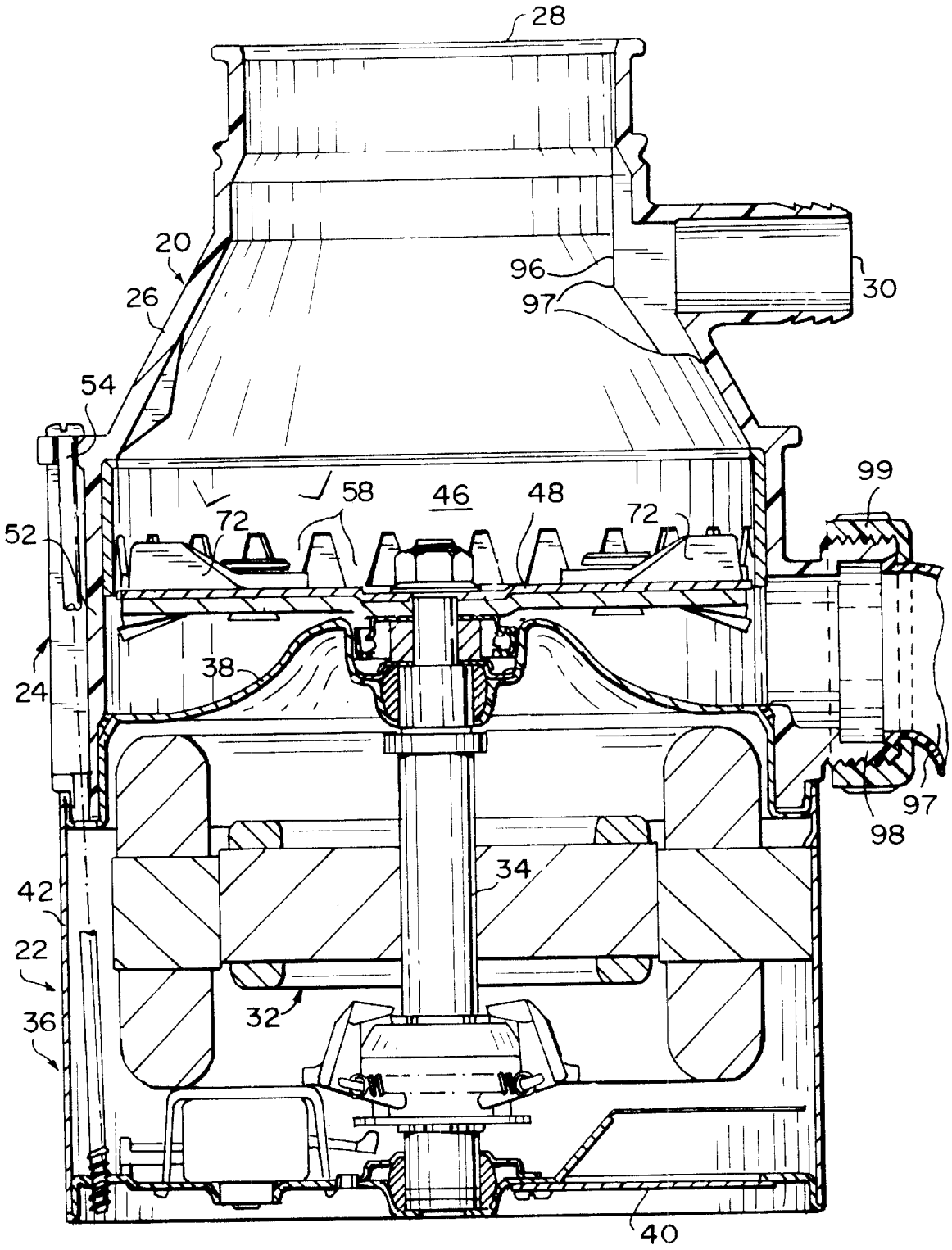
FIG. 1 (PRIOR ART)
FIG. 1 is a cross-section of a typical prior art food waste disposer.
Figure 2:
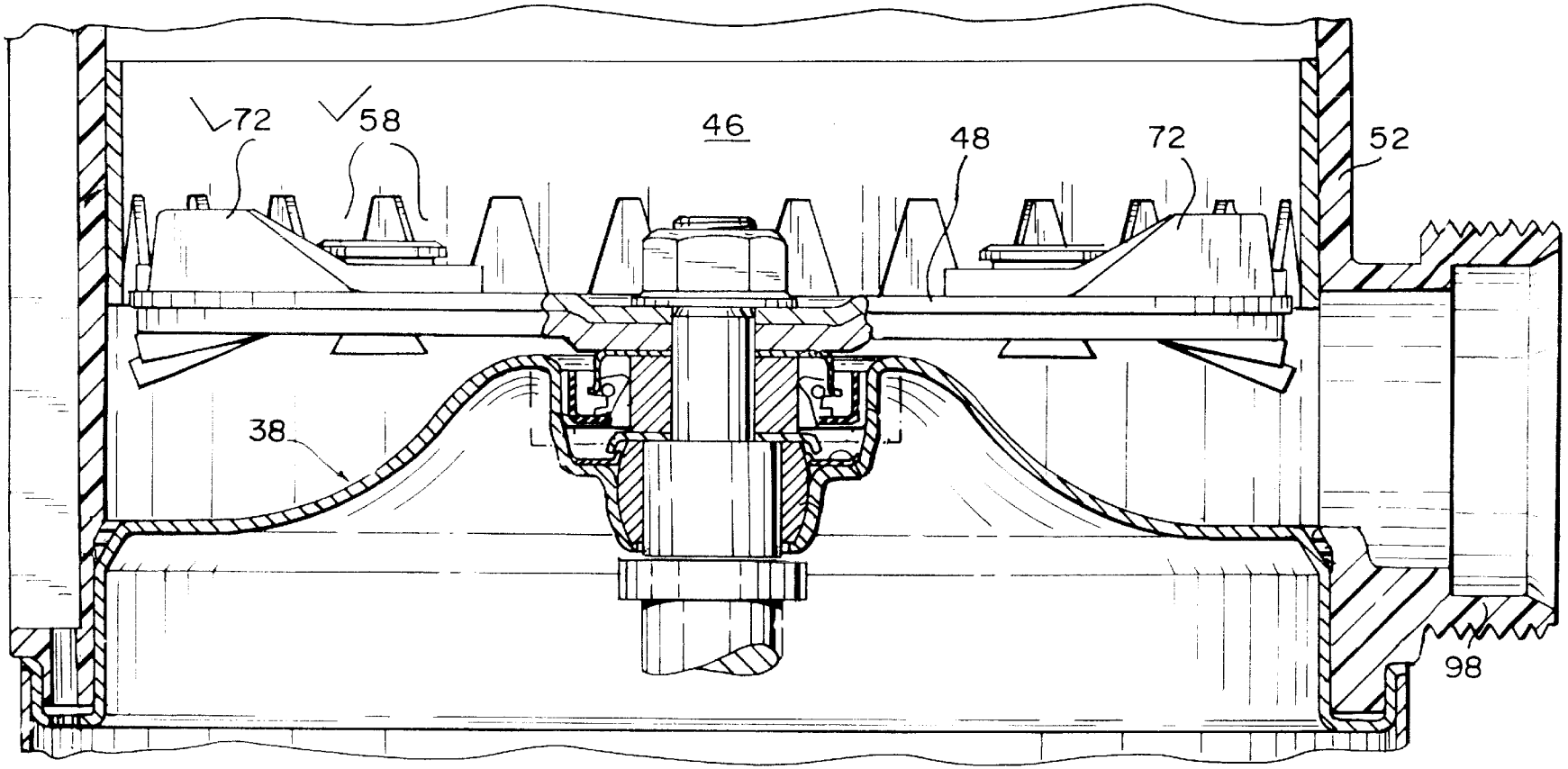
FIG. 2 (PRIOR ART)
FIG. 2 is an enlarged cross-section of the central grinding section of the disposer in FIG. 1.
Figure 3:
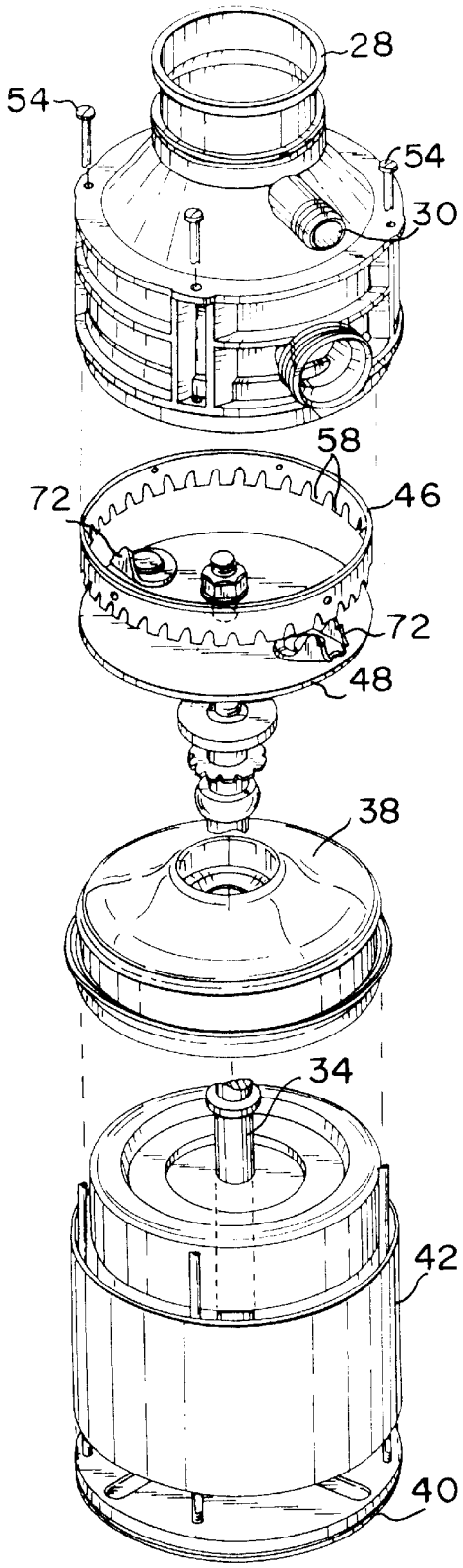
FIG. 3 (PRIOR ART)
FIG. 3 is an exploded perspective view of the disposer in FIG. 1.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF PREFERRED EMBODIMENTS

Figure 4:
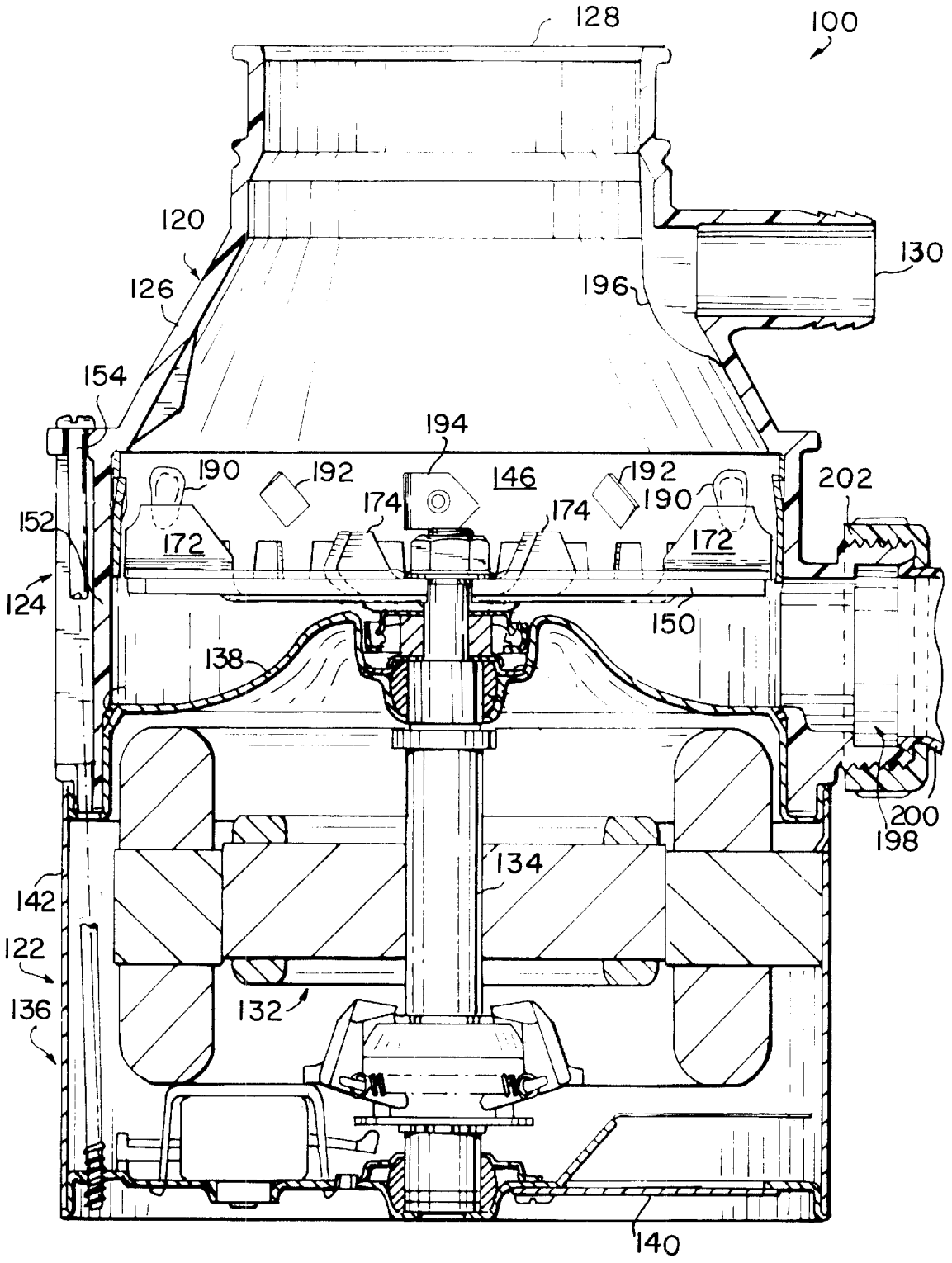
FIG. 4 is a cross-section of one embodiment of the present invention.

Turning to the drawings, FIG. 4 depicts a food waste disposer 100 embodying the present invention. The disposer 100 may be mounted in a well-known manner in the drain opening of a sink using conventional mounting members of the type disclosed in U.S. Pat. No. 3,025,007 (Weiczorek). The disposer includes an upper food conveying section 120, a lower motor section 122, and a central grinding section 124 disposed between the food conveying section 120 and the motor section 122.

The food conveying section 120 includes a housing 126 that forms an inlet 128 at its upper end for receiving food waste and water. The housing 126 may also form an inlet 130 for passing water discharged from a dishwasher (not shown). The food conveying section 120 conveys the food waste to the central grinding section 124. The motor section 122 includes an induction motor 132 imparting rotational movement to a motor shaft 134. The motor 132 is enclosed within a motor housing 136 having an upper end frame 138, a lower end frame 140, and a bent stator band 142 extending between the upper and lower end frames 138 and 140.

Figure 5:
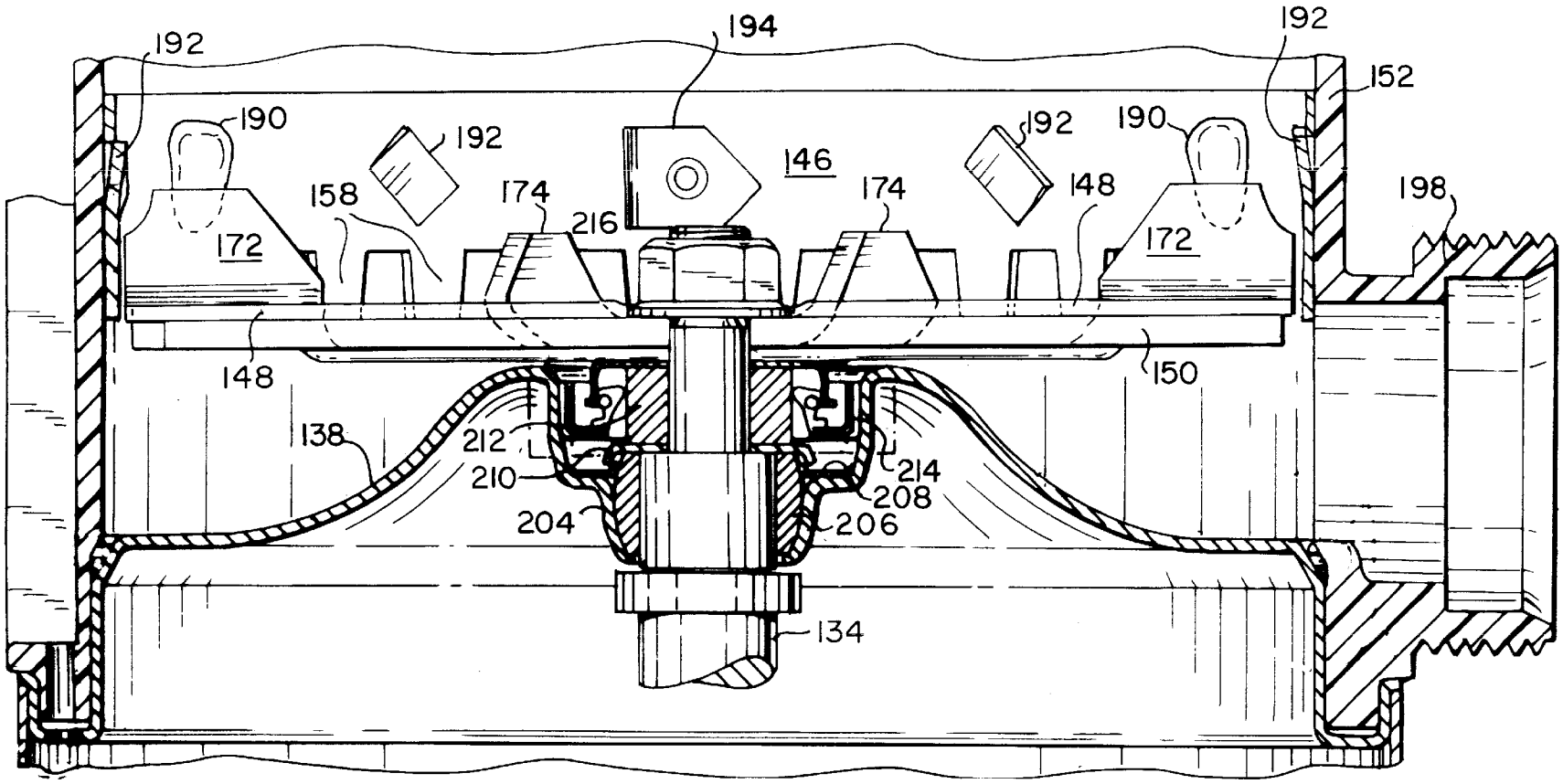
FIG. 5 is an enlarged cross-section of the central grinding section of the disposer in FIG. 4.
Figure 6:
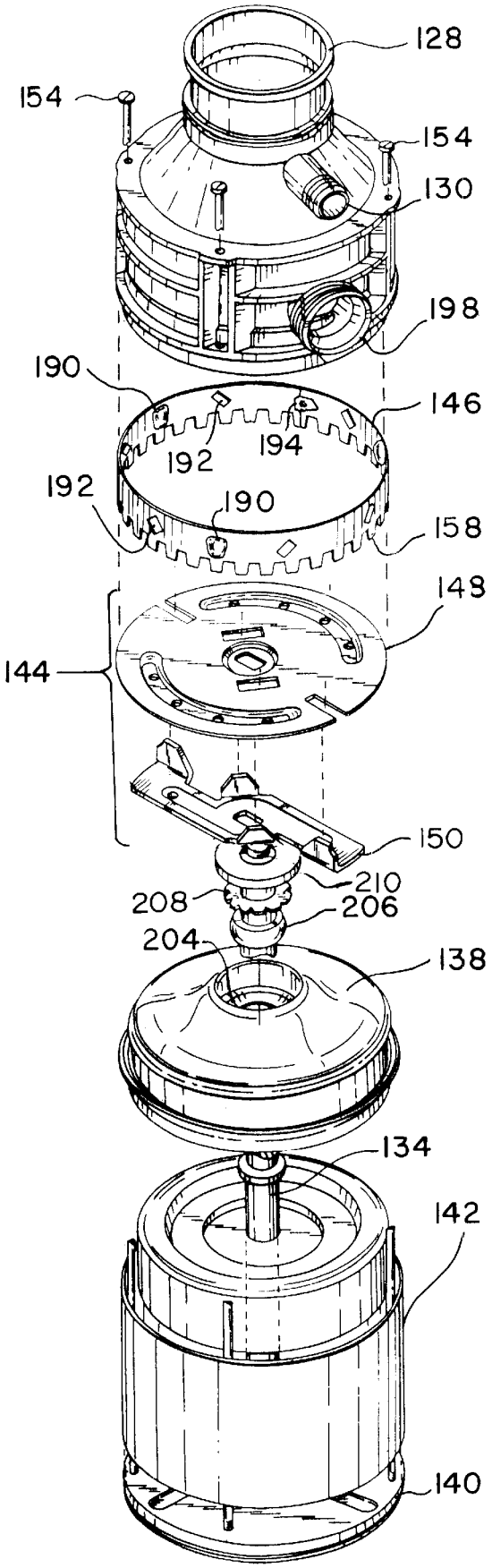
FIG. 6 is an exploded perspective view of the disposer in FIG. 4.

Referring to FIGS. 5 and 6, the grinding section 124 includes a grinding mechanism or assembly having a shredder plate assembly 144 and a stationary shredder ring 146. The shredder plate assembly 144 includes an upper rotating plate 148 and a lower lug support plate 150. The upper rotating plate 148 and lower lug support plate 150 are mounted to the motor shaft 134 of the motor section 122. The grinding section 124 also includes a housing 152 that encompasses the grinding mechanism. The housings 126 and 152 are fastened to the lower end frame 140 by a plurality of bolts 154 having self-tapping threads.

Figure 14:
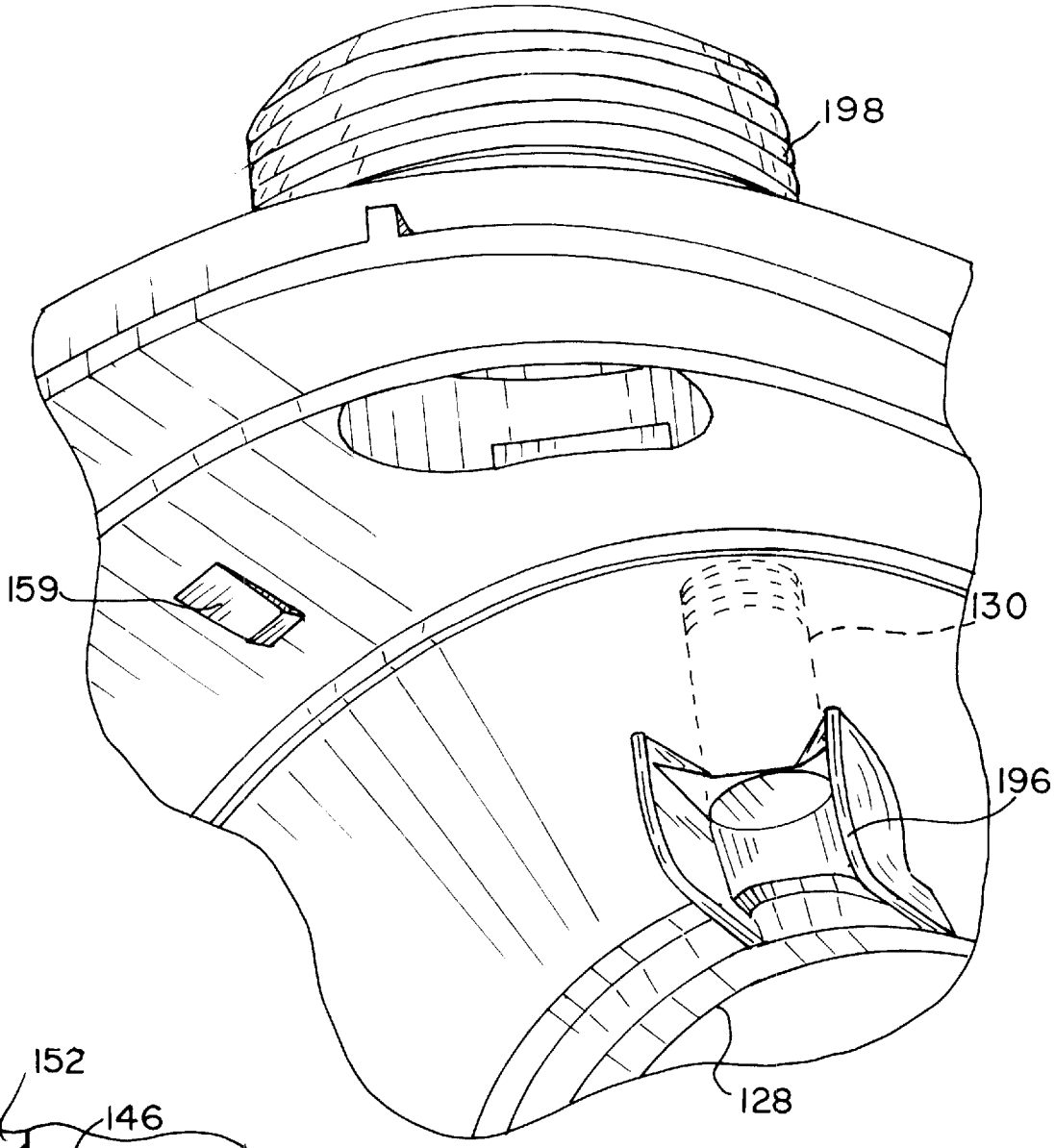
FIG. 14 is a perspective view of the inside of a portion of the housing showing diverters located adjacent to the dishwasher inlet.

The housing 152 of the grinding section 124 encompasses the grinding mechanism. The shredder ring 146, which includes a plurality of spaced teeth 158, is fixedly attached to an inner surface of the housing 152 by an interference fit and is preferably composed of galvanized steel but may be made of other metallic material such as stainless steel. The shredder ring 146 may also be made of non-metallic material such as plastic. The shredder ring 146 may also be formed into the housing 152 by molding or machining techniques. As shown in FIG. 14, which is an inside view of housings 152 and 126, ramps 159 formed on the inside wall of the housing 152 may also be used to enhance the interference between the shredder ring 146 and the housing 152. The housing 152 may be composed of injection-molded plastic, but may be made of metallic material such as powdered metal or steel, or by casting methods such as die-casting or investment casting. The use of injection-molded plastic allows housing 152 to be resistant to corrosion from the shredder ring 146. The present invention, however, is not limited to housings made of injection-molded plastic.

Figure 7:
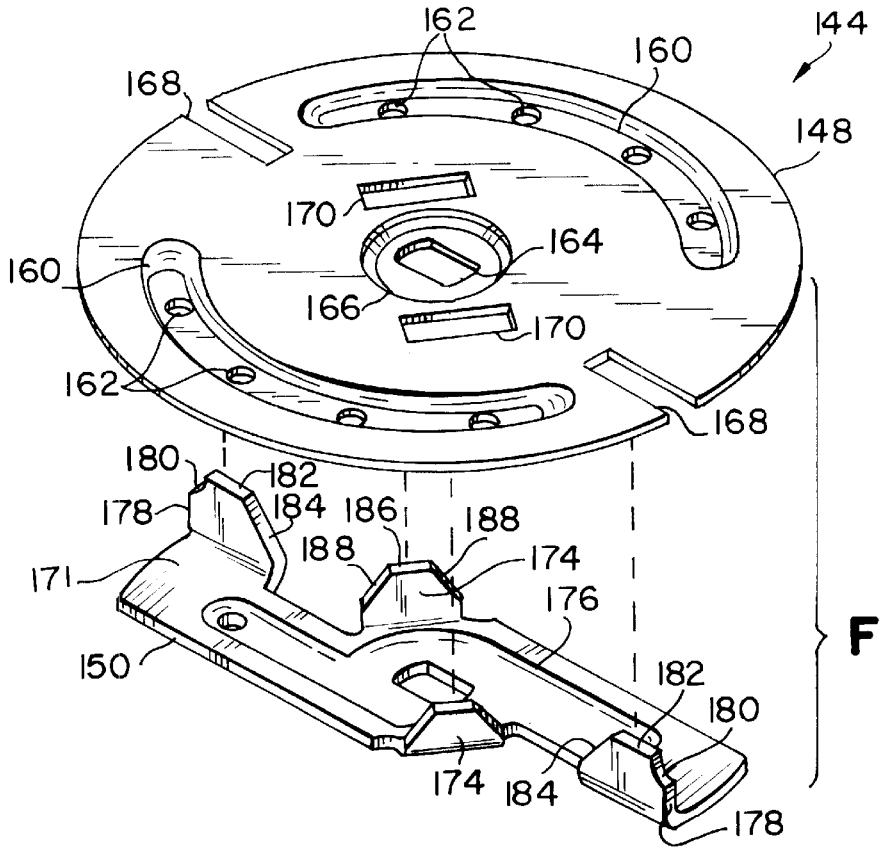
FIG. 7 is an exploded perspective view of one embodiment of a rotating shredder plate assembly.

As seen in FIGS. 6 and 7, the upper rotating plate 148 and lower lug support plate 150 are engaged to form the shredder plate assembly 144. It is preferred that the shredder plate assembly 144 comprise of two engaged components. This reduces the complexity of the manufacturing process and increases the integrity of the grinding mechanism. The upper rotating plate 148 and lower support plate 150, alternatively, may be attached by mechanical means (such as welds or rivets) or by an adhesive known by those skilled in the art. Attaching the components reduces relative movement between the two components and minimizes the number of parts to be handled during final assembly.

In another embodiment, the shredder plate assembly 144 may comprise of a single unitary component that comprises a rotating plate, fixed grinding lugs and tumbling spikes with profiles described below. The fixed grinding lugs and tumbling spikes are mounted on the rotating plate or formed as an integral part of the rotating plate. In such a case, the unitary component may be fabricated from powdered metal methods, by injection molding methods such as insert plastic injection molding or metal injection molding, or by casting methods such as die casting or investment casting.

Figure 8:
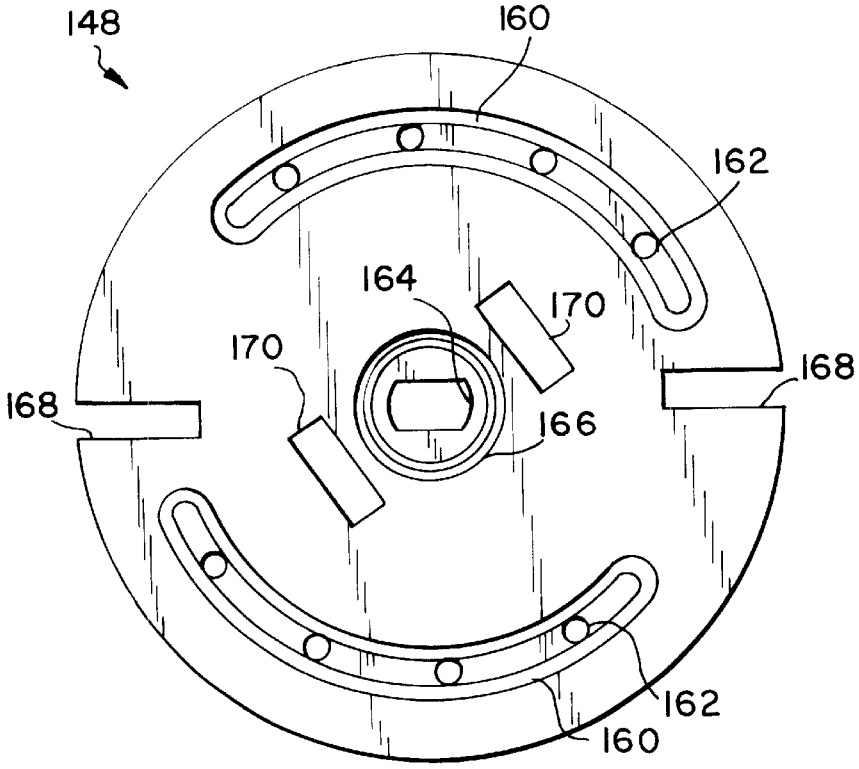
FIG. 8 is a top view of the upper rotating plate for the shredder plate assembly in FIG. 7.

Referring to FIGS. 7 and 8, the upper rotating plate 148 provides a platform, or table, that holds the food waste so that the food waste may be ground. The upper rotating plate 148 may include two strengthening ribs 160 that are preferably disposed concentric to the periphery of the upper rotating plate 148. Inside the strengthening ribs 160, the upper rotating plate 148 includes a plurality of drain holes 162. FIG. 8 shows one embodiment having four drain holes 162 inside each strengthening rib 160. The upper rotating plate 148 also has a mounting hole 164 to mount the upper rotating plate 148 to the motor shaft 134. The mounting hole 164 is preferably in the shape of is a double D to assist in transmitting the torque from the motor shaft 134. The upper rotating plate 148 may also include a strengthening circle 166 to provide further support to the mounting hole 164. To allow the lower lug support plate 150 to engage the upper rotating plate 148, the upper rotating plate includes key slots 168 and key holes 170.

The upper rotating plate 148 may be formed from a flat sheet of metal that is stamped into shape. Alternatively, the upper rotating plate 148 may be formed by powdered metal methods, by injection molding methods such as insert plastic injection molding or metal injection molding, or by casting methods such as diecasting or investment casting. The upper rotating plate 148 preferably has a thickness ranging from about 0.040 inch to about 0.100 inch thick. In a preferred embodiment, the upper rotating plate 148 is composed of double-sided galvanized cold-rolled steel and has a thickness of about 0.071 inch. The upper rotating plate 148 may also be composed of other metallic material such as stainless steel, powdered metal or casting material. The upper rotating plate 148 may also be composed of non-metallic material such as plastic.

Figure 9:
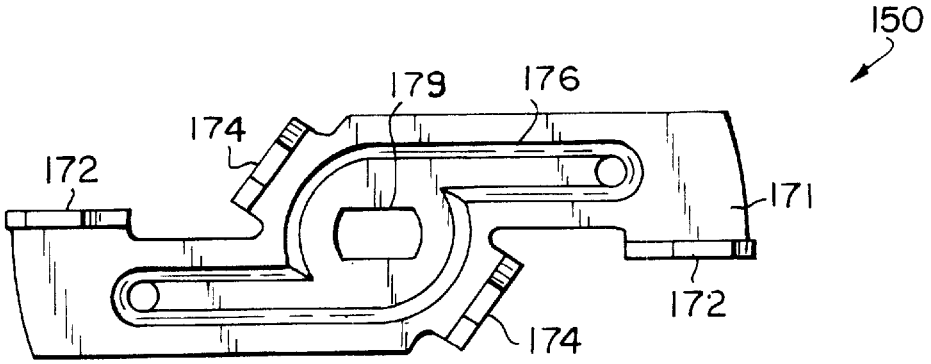
FIG. 9 is a top view of the lower lug support plate for the shredder plate assembly in FIG. 7.
Figure 10:
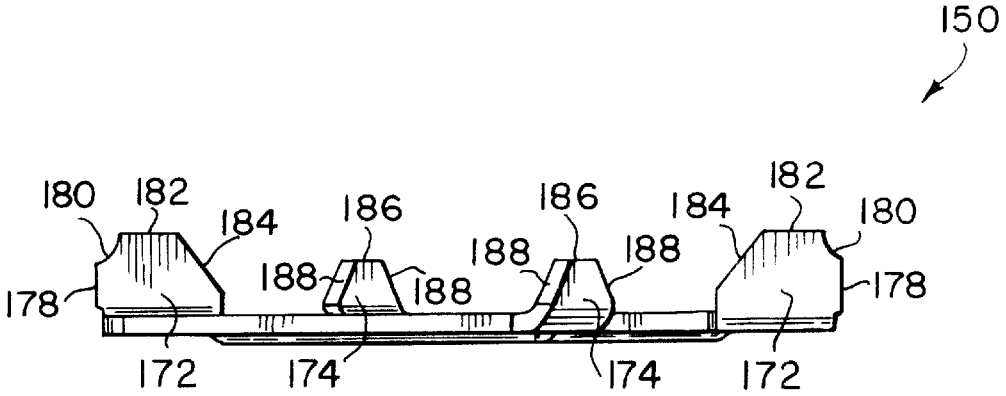
FIG. 10 is a side view of the lower lug support plate for the shredder plate assembly in FIG. 7.

Referring to FIGS. 7, 9 and 10, in one embodiment, the lower lug support plate 150 includes a body portion 171, two fixed shredder lugs 172, and two fixed tumbling spikes 174. The shredder lugs 172 preferably have a vertical toe 178, a curved notch 180, a top 182, and a sloped heel 184. The slope of the heel 184 decreases inwardly toward the center of the lower lug support plate 150. The tumbling spikes 174 preferably have a top 186 and downwardly slanted sides 188. The body portion 171 of the lower lug support plate 150 preferably includes a strengthening rib 176 that runs nearly the full length of the lower lug support plate 150. The lower lug support plate 150 includes a mounting hole 179 to mount the lower lug support plate 150 to the motor shaft 134. The mounting hole 179 is preferably in the shape of a double D to assist in transmitting the torque from the motor shaft 134.

The lower lug support plate 150 may be formed from a flat strip or sheet of metal that is stamped into shape. Like the upper rotating plate 148, the lower lug support plate 150 may also be formed by powdered metal methods, by injection molding methods such as insert plastic injection molding or metal injection molding, or by casting methods such as die-casting or investment casting. The lower lug support plate 150 preferably has a thickness ranging from about 0.090 inch to about 0.190 inch think. In a preferred embodiment, the lower lug support plate 150 is composed of stainless steel and has a thickness of about 0.125 inch thick. The lower lug support plate 150, however, may be made of other metallic material such as cold-rolled steel, powdered metal or casting material. The lower lug support plate 150 may also be composed of non-metallic material such as plastic. If stamping methods are used, the shredder lugs 172 and tumbling spikes 174 may be formed by folding portions of the stamped metal upward. In this way, the shredder lugs 172 and tumbling spikes 174 are an integral part of the lower lug support plate 150. After forming the shredder lugs 172 and the tumbling spikes 174, the lug support plate 150 is preferably heat treated by methods known by those skilled in the art.

FIGS. 7, 9 and 10 show the preferred geometric profile and placement of the shredder lugs 172 and tumbling spikes 174. The dimensions of the shredder lugs 172 and tumbling spikes 174 will depend on the diameter of the upper rotating plate 148 and the outer diameter of the stationary shredder ring 146. The following information provides preferred dimensions assuming that the outer diameter of the rotating plate is about 5.270 inches and the outer diameter of the stationary shredder ring 146 is about 5.453 inches. The present invention, however, is not limited to these dimensions, and those skilled in the art will recognize that the dimensions may change without departing from the spirit and scope of the present invention.

The shredder lugs 172 preferably have a height (distance between top 182 and the top surface of the body portion of the lower lug support plate 150) ranging from about 0.250 inch to about 0.750 inch. In a preferred embodiment, the height of the shredder lugs 172 is about 0.508 inch. The height of the vertical toe 178 preferably ranges from about 0.150 inch to about 0.750 inch. In the preferred embodiment, the height of the vertical toe 178 is about 0.292 inch. The length of the top 182 preferably ranges from about 0.250 inch to about 1.000 inch. In a preferred embodiment, the length of the top 182 is about 0.412 inch. The heel 184 preferably runs a horizontal distance between about 0.000 inch to about 0.700 inch. In a preferred embodiment, the heel 184 runs a horizontal distance of 0.327 inch. The heel 184 preferably is slanted at an angle between about 30 degrees to about 90 degrees. In a preferred embodiment, the heel 184 is slanted at an angle of about 52.2 degrees. The proximity of the heel 184 to the center or axis of the shredder plate assembly 144 preferably ranges from about 1.500 inches to about 2.000 inches. In a preferred embodiment, the proximity of the heel 184 to the inner diameter of the shredder plate assembly 144 is about 1.737 inches. The curved notch 180 preferably has a radius in the ranges from about 0.120 inch to about 0.400 inch. In the preferred embodiment, the curved notch 180 has a radius of about 0.200 inch. The curved notch 180 preferably has a horizontal distance between about 0.060 inch to about 0.250 inch. In a preferred embodiment, the heel 184 has a horizontal distance of 0.150 inch. The thickness of the shredder lug 172 is preferably the same as the thickness of the metal strip that formed the lower lug support plate 150.

The tumbling spikes 174 preferably have a height (distance between top 186 and the top surface of the body portion of the lower lug support plate 150) ranging from about 0.120 inch to about 1.000 inch. In a preferred embodiment, the height of the tumbling spikes 174 is about 0.304 inch. The width at the bottom of the tumbling spike 174 preferably ranges from about 0.250 inch to about 1.250 inches. In the preferred embodiment, the width of the bottom of the tumbling spike 174 is about 0.750 inch. The proximity of the tumbling spikes 174 to the center or axis of the shredder plate assembly 144 preferably ranges from about 0.600 inch to about 1.500 inches. In a preferred embodiment, the proximity of the tumbling spikes 174 to the inner diameter of the shredder plate assembly 144 is about 0.856 inch. The angle of the tumbling spikes 174 relative to the to the shredder lugs 172 preferably ranges from about 90 degrees to about 180 degrees. In a preferred embodiment, the angle of the tumbling spikes 174 relative to the to the shredder lugs 172 is about 125 degrees.

Figure 11:
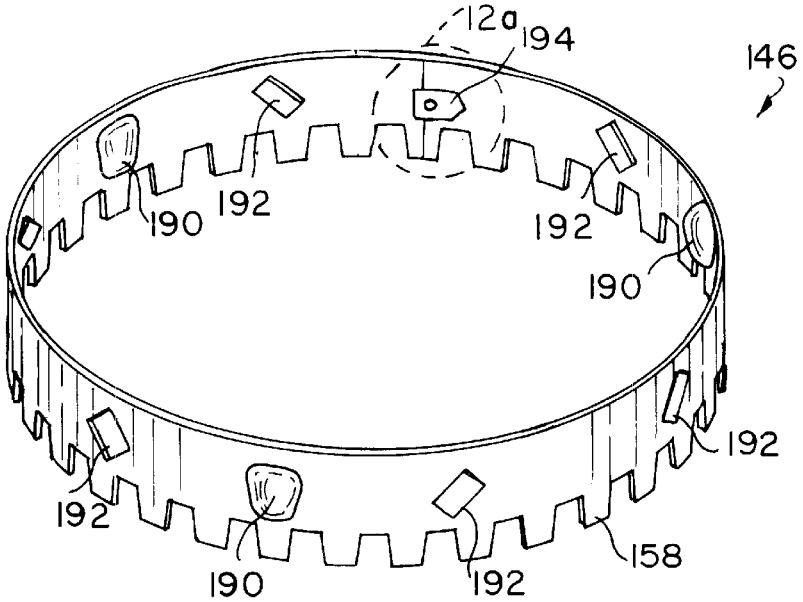
FIG. 11 is a perspective view of one embodiment of the stationary shredder ring.
Figure 11A:
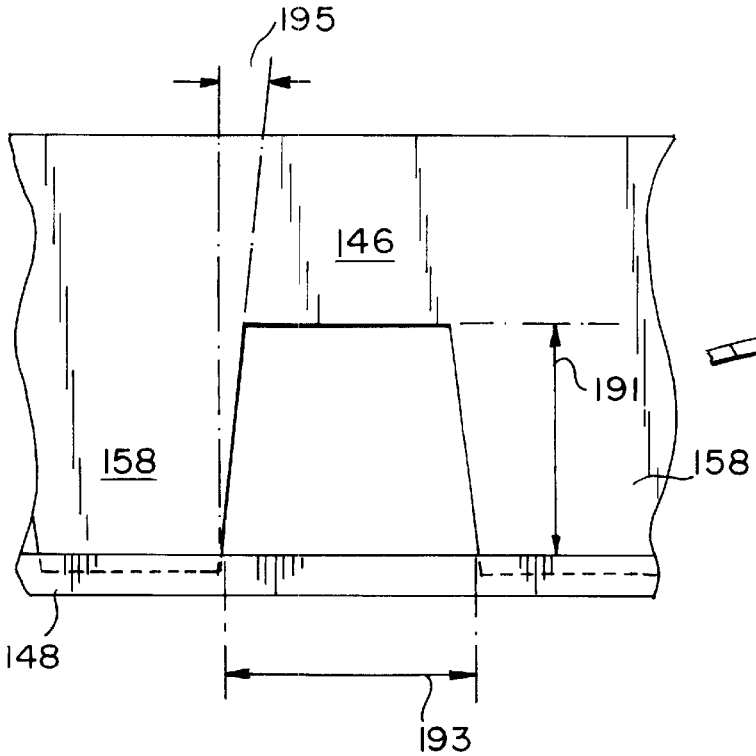
FIG. 11A is a side view of a tooth opening for the stationary shredder ring.

Referring to FIG. 11, the stationary shredder ring 146 may be formed from stamping methods, powdered metal methods, by injection molding methods such as insert plastic injection molding or metal injection molding, or casting methods such as die-casting or investment casting. When composed of stamped metal, the stationary shredder ring 146 preferably has a thickness ranging from about 0.030 inch to about 0.090 inch thick. In a preferred embodiment, the stationary shredder ring 146 is composed of double-sided galvanized cold-rolled steel and has a thickness of about 0.055 inch. The stationary shredder ring 146 may also be made of other metallic material such as stainless steel. The stationary shredder ring 146 may also be made of non-metallic material such as plastic. The stationary shredder ring 146 has a plurality of teeth 158. FIG. 11A shows one embodiment of the profile of the teeth 158. In the preferred embodiment, the stationary shredder ring 146 has thirty-three teeth 158. The teeth 158, however, may be provided with different shapes as required in order to cause particles of different sizes or densities to be ground. The exposed tooth height 191 above the top surface of the rotating shredder plate 148 preferably ranges from about 0.180 inch to about 0.350 inch. In the preferred embodiment, the exposed tooth height 191 is about 0.246 inch. The width of the tooth opening 193 at the top surface of the rotating shredder plate 148 preferably ranges from about 0.125 inch to about 0.375 inch. In the preferred embodiment, the width of the tooth opening is about 0.229 inch. The tooth angle 195 preferably ranges from 0 degrees to about 20 degrees. In the preferred embodiment, the tooth angle 195 is about 4.86 degrees.

Figure 13:
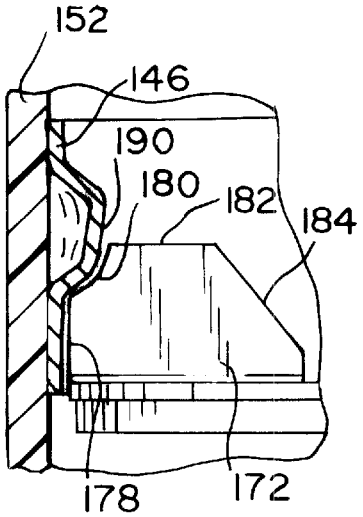
FIG. 13 is a side view of one embodiment of the fixed shredder lug and the diverter of the stationary shredder ring.

As shown in FIG. 11, the stationary shredder ring 146 also has diverters 190 and louvered breakers 192. The diverters 190, along with the shredder lug 172, cause food waste to tumble. When food waste tumbles, it reduces the chances of "riding." As shown in FIGS. 11 and 13, the diverters 190 are bubbled shaped. The protrusion depth of the diverters 190 preferably ranges from about 0.090 inch to about 0.250 inch. In the preferred embodiment, the protrusion depth of the diverters 190 is about 0.165 inch. The height of the diverters 190 preferably ranges from about 0.250 inch to about 0.625 inch. In the preferred embodiment, the height of the diverters 190 is about 0.495 inch. The width of the diverters 190 expands preferably from about 0.125 inch to about 0.375 inch. In the preferred embodiment, the width of the diverters 190 expands to about 0.224 inch.

FIG. 13 illustrates how the profile of the fixed shredder lug 172 aligns with the stationary shredder ring 146 having diverters 190. At least a portion of the diverter 190 passes the fixed shredder lug 172 in close proximity without touching. The notch 180 of the fixed shredder lug 172 is preferably shaped to match the contour of the diverters 190. The distance or gap between the diverters 190 and the fixed shredder lug 172 preferably ranges between about 0.030 inch to about 0.090 inch. In the preferred embodiment, the distance or gap between the diverters 190 and the fixed shredder lug 172 is about 0.050 inch.

Referring again to FIG. 11, the breakers 192 are substantially rectangular and inwardly inclined. The inclined breakers 192 promote a spiraling effect on food waste. FIG. 5 shows a cutaway view of breakers 192. The protrusion depth of the breakers 192 depends on the wall thickness of the stationary shredder ring 146. The depth preferably ranges from about 0.030 inch to about 0.090 inch. In the preferred embodiment, the protrusion depth of the breakers 192 is about 0.055 inch. The width of the breakers 192 preferably ranges from about 0.125 inch to about 0.375 inch. In the preferred embodiment, the width of the breakers 192 is about 0.250 inch. The length of the breakers 192 preferably ranges from about 0.250 inch to about 0.750 inch. In the preferred embodiment, the length of the breakers 192 is about 0.375 inch. The angle of the breakers 192 preferably ranges from about 30 degrees to about 90 degrees. In the preferred embodiment, the angle of the breakers 192 is about 45 degrees. The diverters 190 and breakers 192, however, may be provided with different shapes and number as required in order to cause particles of different sizes or densities to be ground.

Figure 12A:
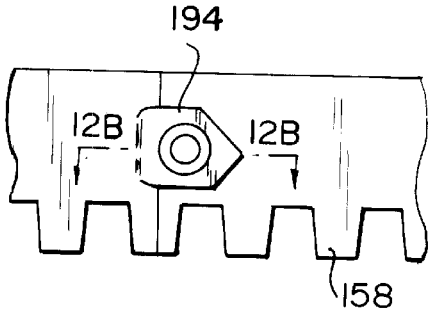
FIG. 12A is a side view of the joining connection for the stationary shredder ring in FIG. 11 using a TOX® round joint.
Figure 12B:
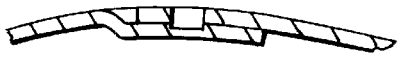
FIG. 12B is a top view of the joining connection for the stationary shredder ring in FIG. 11 using a TOX® round joint.

As indicated above, the stationary shredder ring 146 may be formed from a flat sheet of metal. When composed of stamped metal, the stationary shredder ring 146 may be bent to annular form. The free ends of the shredder ring 146 may be joined at a junction 194 by welding or a material forming process such as a TOX® round joint. A TOX® round joint from TOX® Pressotechnik L.L.C. of 4250 Weaver Parkway, Warrenville, Ill. is very suitable. A junction 194 created using a TOX® round joint is shown in FIGS. 12A and 12B. The benefit of using a TOX® round joint is that the TOX® round joint may serve as one of the louvered breakers 192.

Referring to FIGS. 4 and 14, the inside of the housing 126 of the upper food conveying section 120 may be modified to include a pair of diverters 196. The diverters 196 are located adjacent to the dishwasher inlet 130 and are preferably rounded and/or smooth in shape. The diverters 196 may be formed as part of the housing 126. The use of diverters 196 that are rounded and/or smooth reduces the chances of jamming. As shown in FIG. 1, existing diverters have points 97.

In the operation of the food waste disposer, the food waste delivered by the food conveying section 120 to the grinding section 124 is forced by the shredder lugs 145 on the support lug plate 143 against the teeth 158 of the shredder ring 146. The tumbling spikes 174 assist in the grinding operation by continually moving the food waste. For example, for larger fruit rinds, the tumbling spikes 174 assist in keeping the rind moving so that the teeth 158 receive an opportunity to comminute the waste. The edges of the teeth 158 grind or comminute the food waste into particulate matter sufficiently small to pass from above the shredder plate assembly 144 to below the shredder plate assembly 144 via gaps between the teeth 158 outside the periphery of the upper rotating plate 148. Due to gravity, the particulate matter that passes through the gaps between the teeth 158 drops onto the upper end frame 138 and, along with water injected into the disposer 100 via the inlet 128, is discharged through a discharge outlet 198 into a tailpipe 200. To direct the mixture of particulate matter and water toward the discharge outlet 198, the upper end frame 138 is sloped downward toward its periphery.

As shown in FIGS. 5 and 6, in one embodiment, the discharge outlet 198 is formed by the housing 152 and has a threaded outer surface. The threaded outer surface of the discharge outlet 198 allows the tailpipe 200 to be connected to the discharge outlet 198 using an off-the-shelf plumbing nut 202. By designing the discharge outlet 198 to accept the standard plumbing nut 202, the food waste disposer 100 is significantly easier to connect to a plumbing system in the field than existing disposers. The present invention, however, is not limited to threaded discharge outlets. There are other ways known to those skilled in the art to attach the discharge of a food waste disposer to a tailpipe. One such way is discussed in the background section of U.S. Pat. No. 6,007,006 (Engel et al.).

The upper end frame 138 separates the grinding section 124 from the motor 132. To promote concentricity of the motor shaft 134 relative to the stator band 142 and of the upper rotating plate 148 relative to the shredder ring 146, a peripheral lip of the upper end frame 138 is secured between the housing 152 and the stator band 142. The upper end frame 138 dissipates the heat generated by the motor 132, prevents particulate matter and water from contacting the motor 132, and directs the mixture of particulate matter and water to the discharge outlet 198.

Referring to FIGS. 5 and 6, to align the motor shaft 134 relative to the stator band 142 and, at the same time, permit rotation of the motor shaft 134 relative to the upper end frame 138, the upper end frame 138 forms a central bearing pocket 204 supporting a powdered metal spherical bearing 206. The spherical bearing 206 encompasses the motor shaft 134 and is retained in the bearing pocket 204 by a steel bearing retainer 208. To evenly distribute downward loads created by the grinding mechanism onto the bearing 206, a thrust washer 210 encompasses the motor shaft 134 and is positioned immediately above the spherical bearing 206. A steel sleeve 212 encompasses the motor shaft 134, is positioned immediately above the thrust washer 210, and is surrounded by a spring-loaded rubber seal 214. Finally, the steel sleeve 212 is covered by a steel cap 216 for keeping out debris.

It is preferred that the housings 126 and 152 be made of injection-molded plastic integrally formed with each other using conventional injection-molding techniques, and that the upper end frame 138 is separately formed from the housings 126 and 152 using conventional cold stamping techniques. U.S. Pat. No. 6,007,006 (Engel et al.), which is owned by the assignee of the present application and incorporated herein by reference in its entirety, provides further information on a food waste disposer using injection-molded plastic housings and a stamped metal upper end frame. By integrating the plastic housings 126 and 152 via injection molding and separately forming the upper end frame 138 from stamped metal, the food waste disposer 100 is easier and less expensive to manufacture than existing disposers. The present invention is not, however, limited to housings made of injection-molded plastic and frames made using cold stamping techniques. As indicated above, the housings 126 and 152 may be made of powdered metal, casting material, stainless steel or other metallic material. Moreover, the upper end frame 138 may be made of plastic, powdered metal, casting material, stainless steel or other metallic material.

Figure 15:
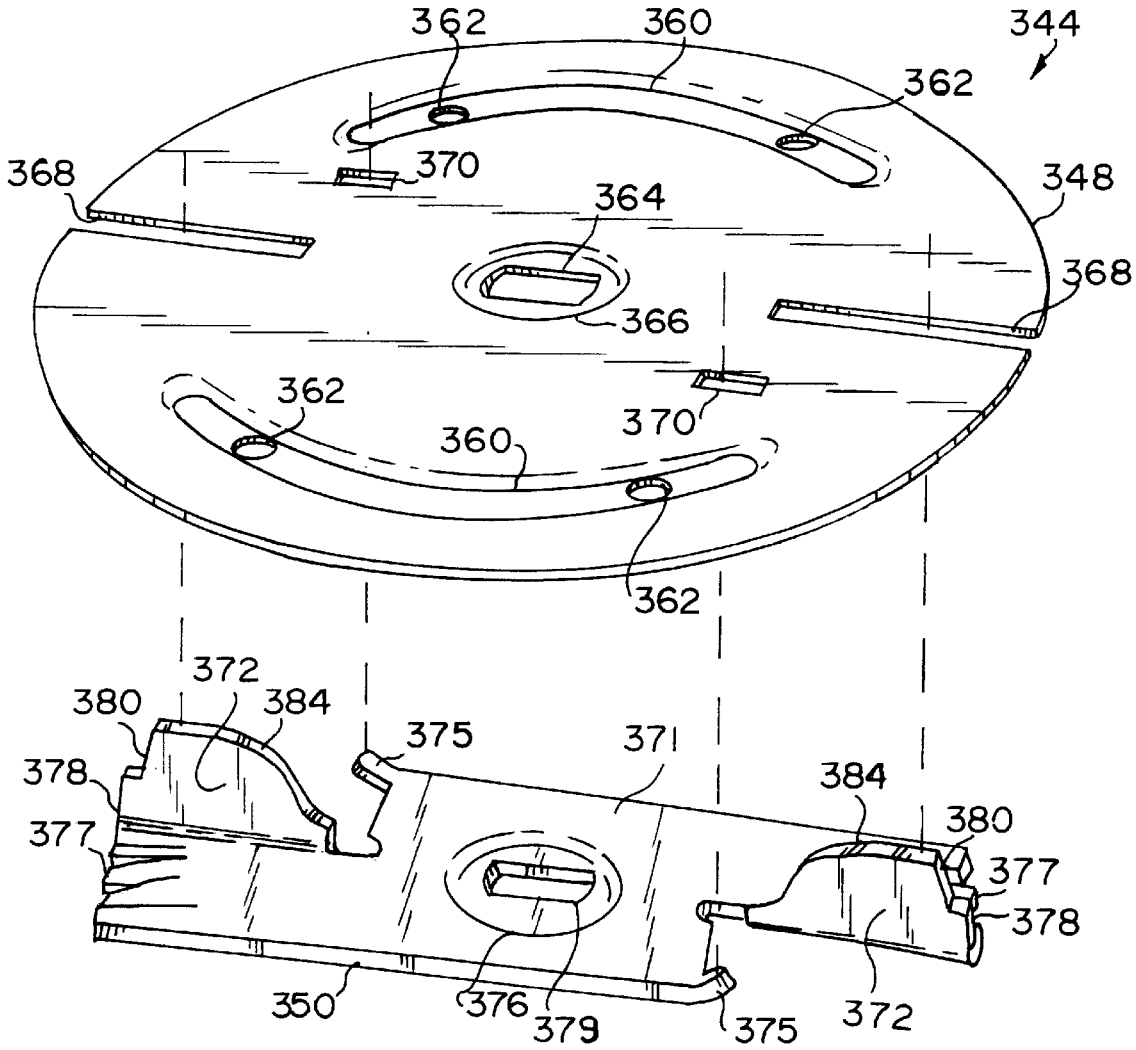
FIG. 15 is an exploded perspective view of another embodiment of a rotating shredder plate assembly.

Referring to FIG. 15, an alternative embodiment of the shredder plate assembly is shown. The upper rotating plate 348 and lower lug support plate 350 are engaged to form the shredder plate assembly 344. Similar to the assembly in FIG. 7, the upper rotating plate 348 and lower lug support plate 350 may be formed by stamping methods, by powdered metal methods, by injection molding methods such as insert plastic injection molding or metal injection molding, or by casting methods such as die-casting or investment casting.

The upper rotating plate 348 provides a platform, or table, that holds the food waste so that the food waste may be ground. The upper rotating plate 348 may include two strengthening ribs 360. The strengthening ribs 360 are preferably disposed concentric to the periphery of the upper rotating plate 348. Inside the strengthening ribs 360, the upper rotating plate 348 includes a plurality of drain holes 362. FIG. 15 shows one embodiment having two drain holes 362 inside each strengthening rib 360. The upper rotating plate 348 also has a mounting hole 364 to mount the upper rotating plate 348 to the motor shaft 134. The mounting hole 364 is in the shape of a double D to assist in transmitting the torque from the motor shaft 134. The upper rotating plate 348 may also include a strengthening circle 366 to provide further support to the mounting hole 364. To allow the lower lug support plate 350 to engage the upper rotating plate 348, the upper rotating plate includes key slots 368 and key holes 370.

In this embodiment, the lower lug support plate 350 includes a body portion 371, two fixed shredder lugs 372, two positive locators 375, and pumping fingers 377. The shredder lugs 372 have a vertical toe 378, a notch 380, and a sloping heel 384. Although a curved notch experiences less jams, the embodiment in FIG. 15 illustrates that a non-curved notch 380 may also be used, especially where the diverters 190 are also not curved. FIG. 15 also illustrates that the sloping heel 384 may decrease in a convex manner inwardly toward the center of the lower lug support plate 350. The positive locators 375 may also be used to assist in the assembly of the grinding mechanism. The positive locators 375 stabilize the shredder plate assembly 344 and transfer the torque from the lower lug support plate 350 to the upper rotating plate 348. The pumping fingers 377 are protrusions on the outer diameter of the lower lug support plate 350. The pumping fingers 377 are located under the upper rotating plate 348 and create a larger frontal area relative to the direction of rotation. The larger frontal area creates an increased pumping pressure through the discharge outlet 198. The pumping fingers 377 may also be lengthened to pass below the stationary shredder ring 146. The lengthening the pumping fingers 377 improves the fineness of the grind performance.

The lower lug support plate 350 also includes a mounting hole 179 to mount the lower lug support plate 350 to the motor shaft 134. The mounting hole 379 is in the shape of a double D to assist in transmitting the torque from the motor shaft 134. The lower lug support plate 350 may also include a strengthening circle 376 to provide further support to the mounting hole 379. Similar to the lower lug support plate 150 in FIG. 7, if the lower lug support plate 350 is formed by stamping methods, the shredder lugs 372 and positive locators 375 may be formed by folding portions of the stamped metal upward.

Figure 16:
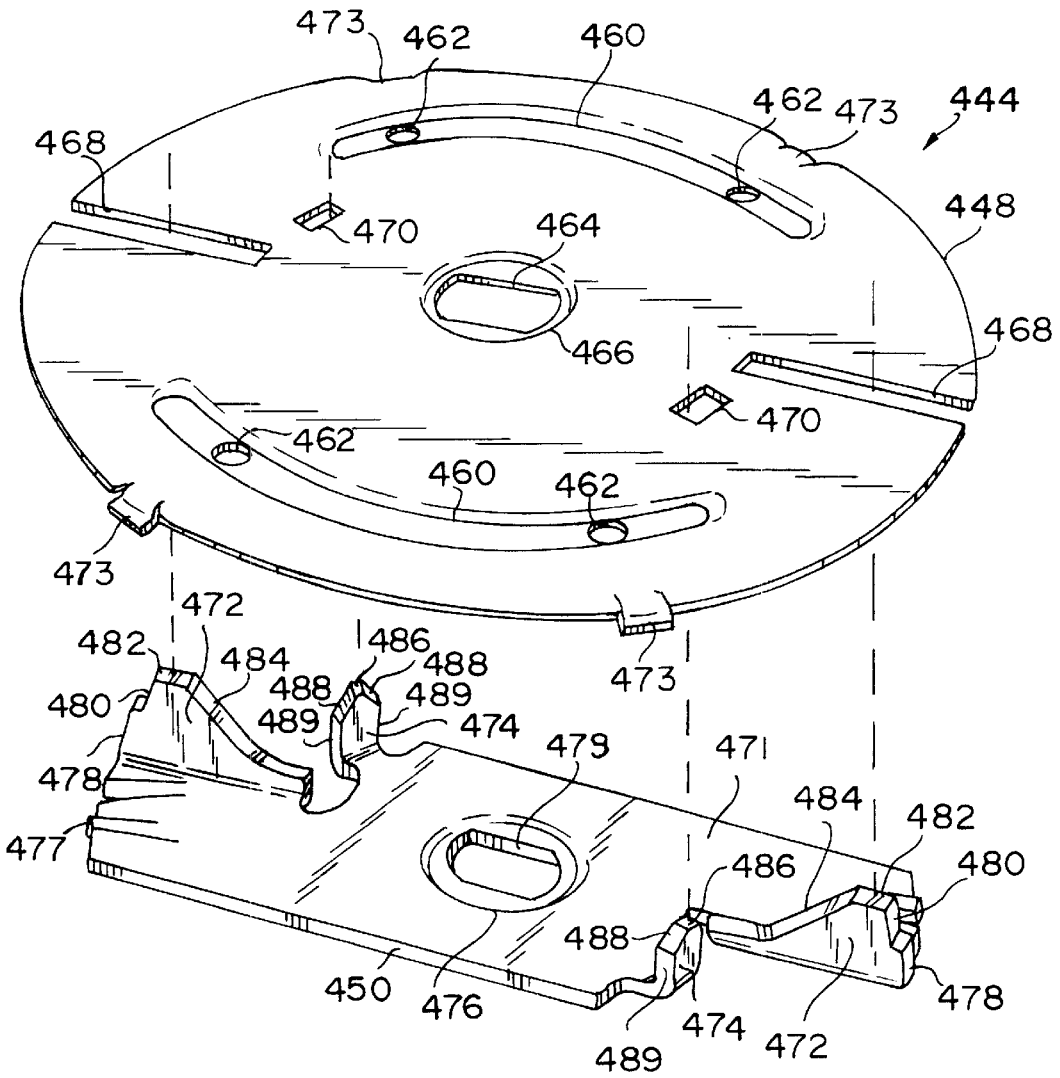
FIG. 16 is an exploded perspective view of a further embodiment of a rotating shredder plate assembly.

Referring to FIG. 16, another embodiment of the shredder plate assembly is shown. The upper rotating plate 448 and lower lug support plate 450 are engaged to form the shredder plate assembly 444. Similar to the assembly in FIG. 7, the upper rotating plate 448 and lower lug support plate 450 may be formed by stamping methods, by powdered metal methods, by injection molding methods such as insert plastic injection molding or metal injection molding, or by casting methods such as die-casting or investment casting.

The upper rotating plate 448 provides a platform, or table, that holds the food waste so that the food waste may be ground. The upper rotating plate 448 may include two strengthening ribs 460. The strengthening ribs 460 are preferably disposed concentric to the periphery of the upper rotating plate 448. Inside the strengthening ribs 460, the upper rotating plate 448 includes a plurality of drain holes 462. FIG. 16 shows one embodiment having two drain holes 462 inside each strengthening rib 460. The upper rotating plate 448 also has a mounting hole 464 to mount the upper rotating plate 448 to the motor shaft 134. The mounting hole 464 is in the shape of a double D to assist in transmitting the torque from the motor shaft 134. The upper rotating plate 448 may also include a strengthening circle 466 to provide further support to the mounting hole 464. To allow the lower lug support plate 450 to engage the upper rotating plate 448, the upper rotating plate includes key slots 468 and key holes 470.

Figure 18:
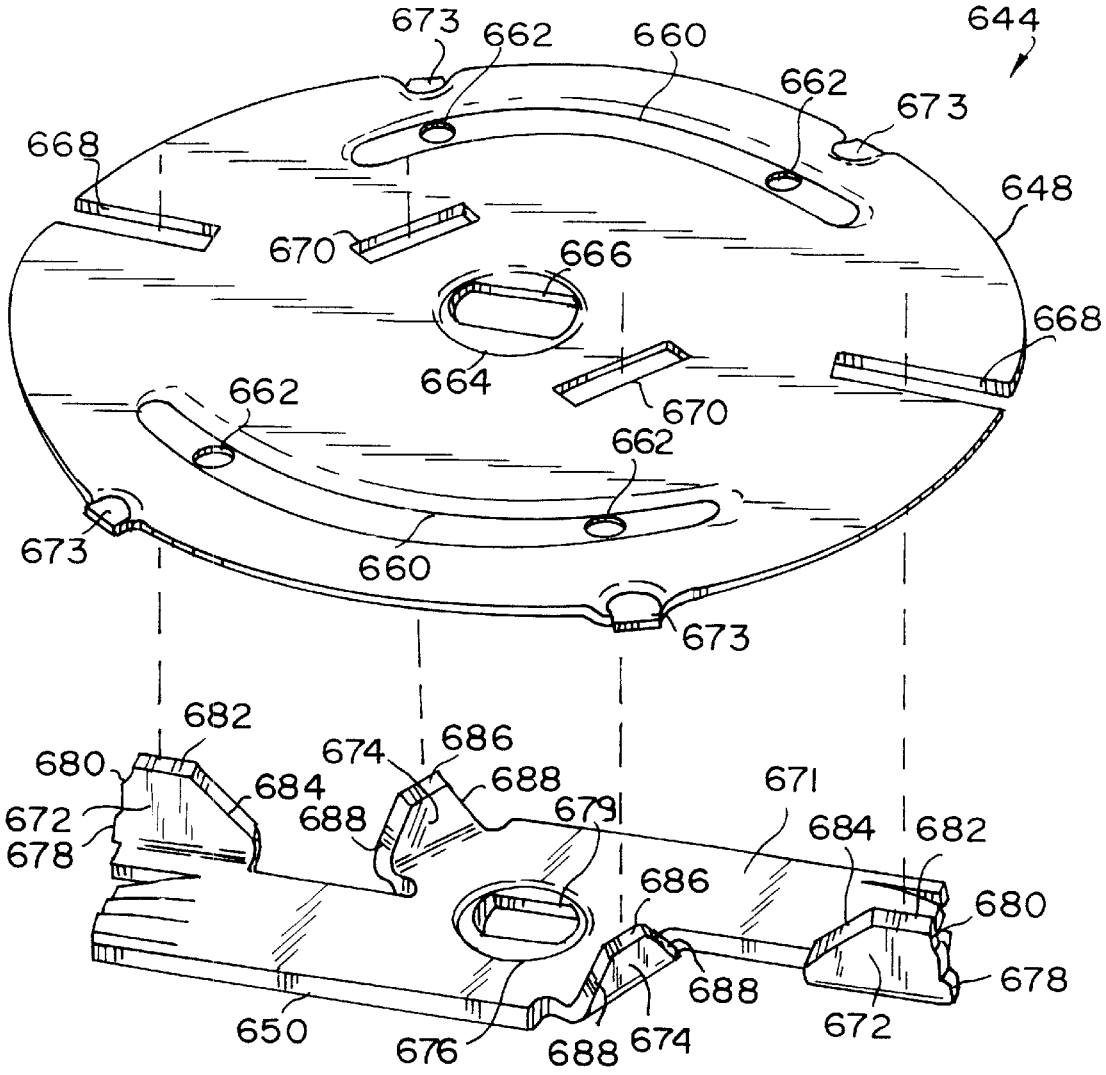
FIG. 18 is an exploded perspective view of still another embodiment of a rotating shredder plate assembly.

In this embodiment, the upper rotating plate 488 also includes a plurality of under-cutters 473. The under-cutters 473 are protrusions that extend beyond the outer diameter of the upper rotating plate 448. The under-cutters 473 also pass below the stationary shredder ring 146. The use of under-cutters 473 can improve the cutting and fineness of the grind performance. If stamping methods are used to form the upper rotating plate 488, the under-cutters 473 are formed by stamping the edge of the upper rotating plate 448. As shown in FIG. 16, one geometry of the under-cutters 473 may be substantially rectangular. Another geometry is shown in FIG. 18 where the under-cutters are concave. Concave under-cutters experience better resistance to jams.

The lower lug support plate 450 includes a body portion 471, two fixed shredder lugs 472, two fixed tumbling spikes 474, and pumping fingers 477. The shredder lugs 472 have a vertical toe 478, a notch 480, a top 482, and a sloping heel 484. The shredder lugs 472 in this embodiment differ from those shown in FIGS. 9 and 10 in that the shredder lugs 472 have a reduced profile. Additionally, the notch 480 is not curved. The slope of the heel 484 decreases inwardly toward the center of the lower lug support plate 450. The tumbling spikes 474 preferably have a top 486, slanted sides 488 and vertical sides 489. The tumbling spikes 474 in this embodiment differ from those shown in FIGS. 9 and 10 in that the tumbling spikes 474 have an increased height and reduced width. As described above, the pumping fingers 477 are protrusions that increase pumping pressure through the discharge outlet 198 and improve the fineness of the grind performance.

The lower lug support plate 450 also includes a mounting hole 479 to, mount the lower lug support plate 450 to the motor shaft 134. The mounting hole 479 is in the shape of a double D to assist in transmitting the torque from the motor shaft 134. The lower lug support plate 450 may also include a strengthening circle 476 to provide further support to the mounting hole 479. Similar to the lower lug support plate 150 in FIG. 7, if the lower lug support plate 450 is formed by stamping methods, the shredder lug 472 and tumbling spikes 474 may be formed by folding portions of the stamped metal upward.

Figure 17:
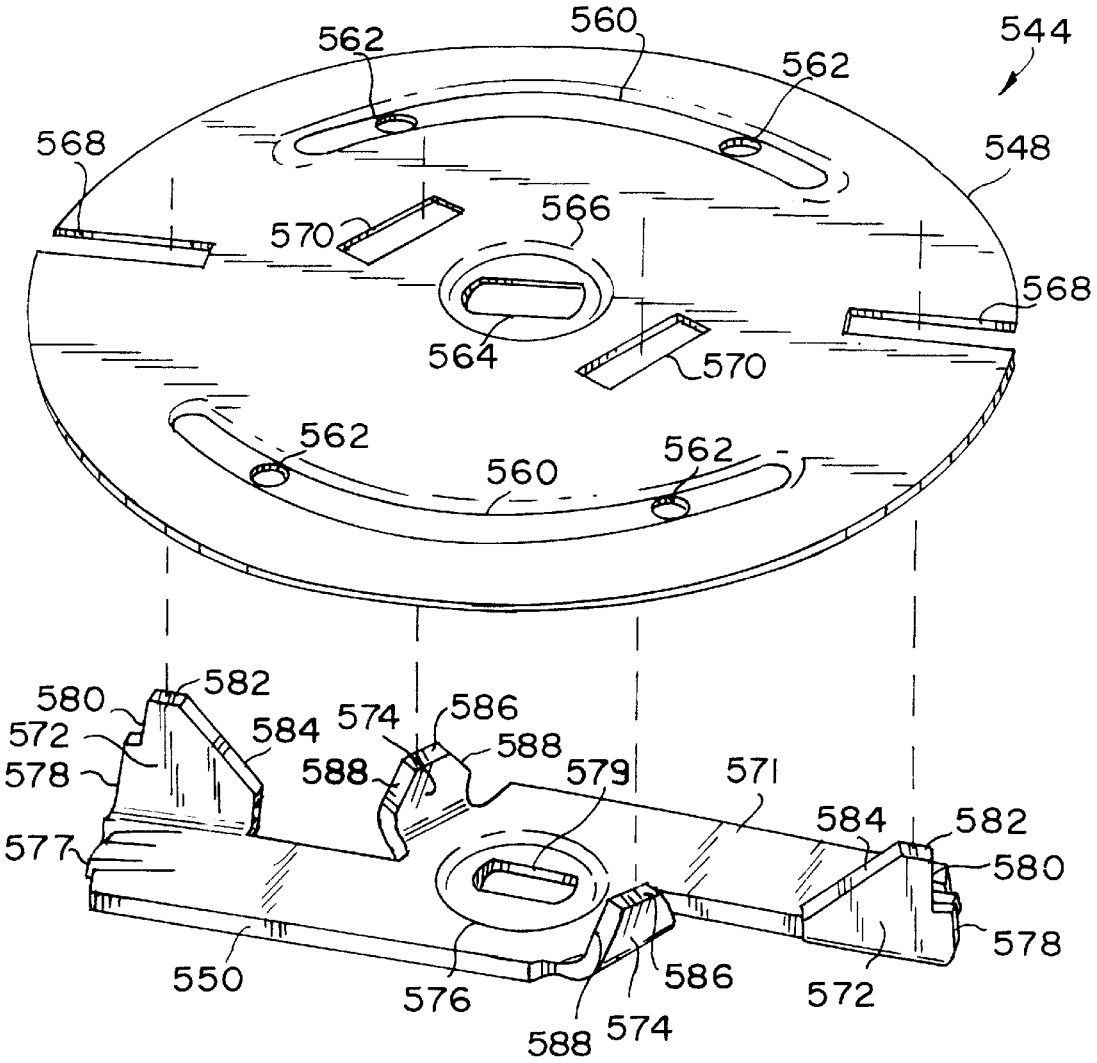
FIG. 17 is an exploded perspective view of yet another embodiment of a rotating shredder plate assembly.

Referring to FIG. 17, a further embodiment of the shredder plate assembly is shown. The upper rotating plate 548 and lower lug support plate 550 are engaged to form the shredder plate assembly 544. Similar to the assembly in FIG. 7, the upper rotating plate 548 and lower lug support plate 550 may be formed by stamping methods, by powdered metal methods, by injection molding methods such as insert plastic injection molding or metal injection molding, or by casting methods such as die-casting or investment casting.

The upper rotating plate 548 provides a platform, or table, that holds the food waste so that the food waste may be ground. The upper rotating plate 548 may include two strengthening ribs 560. The strengthening ribs 560 are preferably disposed concentric to the periphery of the upper rotating plate 548. Inside the strengthening ribs 560, the upper rotating plate 548 includes a plurality of drain holes 562. FIG. 17 shows one embodiment having two drain holes 562 inside each strengthening rib 560. The upper rotating plate 548 also has a mounting hole 564 to mount the upper rotating plate 548 to the motor shaft 134. The mounting hole 564 is in the shape of a double D to assist in transmitting the torque from the motor shaft 134. The upper rotating plate 548 may also include a strengthening circle 566 to provide further support to the mounting hole 564. To allow the lower lug support plate 550 to engage the upper rotating plate 548, the upper rotating plate includes key slots 568 and key holes 570.

The lower lug support plate 550 includes a body portion 571, two fixed shredder lugs 572, two fixed tumbling spikes 574, and pumping fingers 577. The shredder lugs 572 have a vertical toe 578, a notch 580, a top 582, and a sloping heel 584. The slope of the heel 584 decreases inwardly toward the center of the lower lug support plate 550. In this embodiment, however, the horizontal run of the heel 584 is reduced as compared to the heel 284 shown in FIGS. 9 and 10. Moreover, the height of the shredder lugs 572 is increased. The tumbling spikes 574 preferably have a top 586 and slanted sides 588. As described above, the pumping fingers 577 are protrusions that increase pumping pressure through the discharge outlet 198 and improve the fineness of the grind performance.

The lower lug support plate 550 also includes a mounting hole 579 to mount the lower lug support plate 550 to the motor shaft 134. The mounting hole 579 is in the shape of a double D to assist in transmitting the torque from the motor shaft 134.

The lower lug support plate 550 may also include a strengthening circle 576 to provide further support to the mounting hole 579. Similar to the lower lug support plate 150 in FIG. 7, if the lower lug support plate 550 is formed by stamping methods, the shredder lug 572 and tumbling spikes 574 may be formed by folding portions of the stamped metal upward.

Referring to FIG. 18, an alternative embodiment of the shredder plate assembly is shown. The upper rotating plate 648 and lower lug support plate 650 are engaged to form the shredder plate assembly 644. Similar to the assembly in FIG. 7, the upper rotating plate 648 and lower lug support plate 650 may be formed by is stamping methods, by powdered metal methods, by injection molding methods such as insert plastic injection molding or metal injection molding, or by casting methods such as die-casting or investment casting.

The upper rotating plate 648 provides a platform, or table, that holds the food waste so that the food waste may be ground. The upper rotating plate 648 may include two strengthening ribs 660. The strengthening ribs 660 are preferably disposed concentric to the periphery of the upper rotating plate 648. Inside the strengthening ribs 660, the upper rotating plate 648 includes a plurality of drain holes 662. FIG. 18 shows one embodiment having two drain holes 662 inside each strengthening rib 660. The upper rotating plate 648 also has a mounting hole 664 to mount the upper rotating plate 648 to the motor shaft 134. The mounting hole 664 is in the shape of a double D to assist in transmitting the torque from the motor shaft 134. The upper rotating plate 648 may also include a strengthening circle 666 to provide further support to the mounting hole 664. To allow the lower lug support plate 650 to engage the upper rotating plate 648, the upper rotating plate includes key slots 668 and key holes 670.

In this embodiment, the upper rotating plate 688 also includes a plurality of concave under-cutters 673. The under-cutters 673 are protrusions that extend beyond the outer diameter of the upper rotating plate 648. The under-cutters 673 also pass below the stationary shredder ring 146. The use of under-cutters 673 can improve the cutting and fineness of the grind performance. If stamping methods are used to form the upper rotating plate 688, the under-cutters 673 are formed by stamping the edge of the upper rotating plate 648. The concave geometry of the under-cutters 673 also resists jams.

The lower lug support plate 650 includes a body portion 671, two fixed shredder lugs 672, two fixed tumbling spikes 674, and pumping fingers 677. As described above, the pumping fingers 677 are protrusions that increase pumping pressure through the discharge outlet 198 and improve the fineness of the grind performance.

The shredder lugs 672 have a vertical toe 678, a notch 680, a top 682, and a slanting toe 684. The shredder lugs 672 in this embodiment differ from those shown in FIGS. 9 and 10 in that the shredder lugs 672 have a reduced profile. The slope of the slanting toe 684 decreases inwardly toward the center of the lug support plate 650. The tumbling spikes 674 have a top 686,and slanted sides 688. The lower lug support plate 650 includes a mounting hole 679 to mount the lower lug support plate 650 to the motor shaft 134. The mounting hole 679 is in the shape of a double D to assist in transmitting the torque from the motor shaft 134. The lower lug support plate 650 may also include a strengthening circle 676 to provide further support to the mounting hole 679. Similar to the lower lug support plate 150 in FIG. 7, if the lower lug support plate 650 is formed by stamping, the shredder lug 672 and tumbling spikes 674 may be formed by folding portions of the stamped metal upward.

Figure 19A:
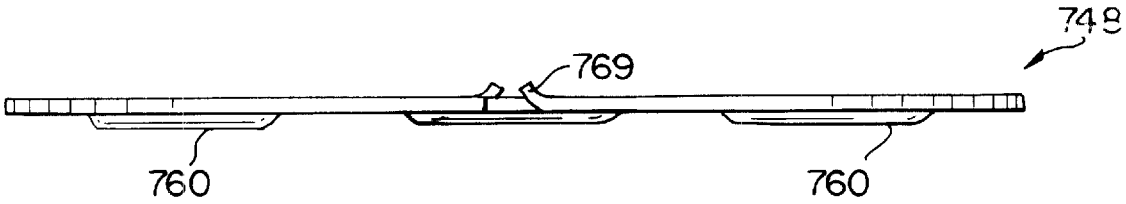
FIGS. 19A and 19B are perspective and side views of a further embodiment of the upper rotating plate for the rotating shredder plate assembly.
Figure 19B:
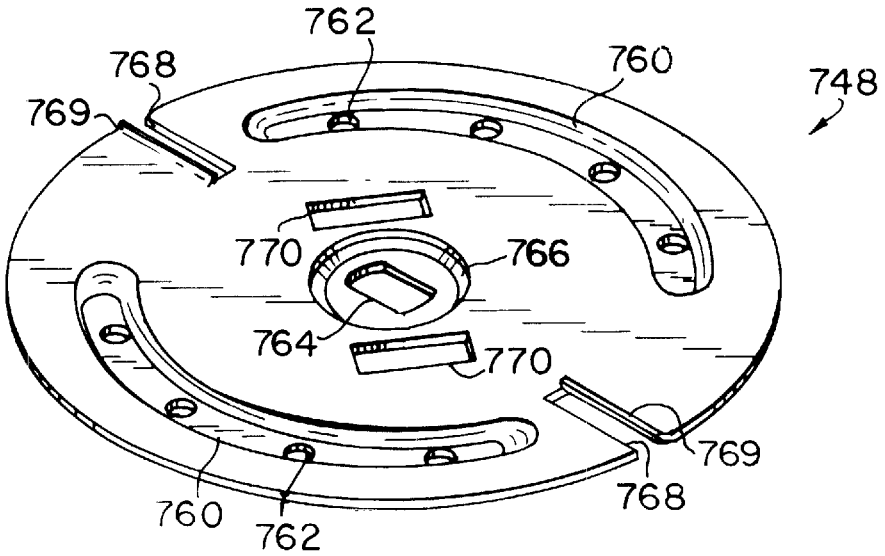

Referring to FIGS. 19A and 19B, an alternative embodiment of the upper rotating plate 748 is shown. Similar to the upper rotating plate 148 in FIG. 7, the upper rotating plate 748 may be formed by stamping methods, by powdered metal methods, by injection molding methods such as insert plastic injection molding or metal injection molding, or by casting methods such as die-casting or investment casting. The upper rotating plate 748 provides a platform, or table, that holds the food waste so that the food waste may be ground. The upper rotating plate 748 may include two strengthening ribs 760. The strengthening ribs 760 are preferably disposed concentric to the periphery of the upper rotating plate 748. Inside the strengthening ribs 760, the upper rotating plate 748 includes a plurality of drain holes 762. FIG. 19B shows one embodiment having four drain holes 762 inside each strengthening rib 760. The upper rotating plate 748 also has a mounting hole 764 to mount the upper rotating plate 748 to the motor shaft 134. The mounting hole 764 is preferably in the shape of a double D to assist in transmitting the torque from the motor shaft 134. The upper rotating plate 748 may also include a strengthening circle 766 to provide further support to the mounting hole 764. To allow the lower lug support plate 750 to engage the upper rotating plate 748, the upper rotating plate includes key slots 768 and key holes 770. In this embodiment, the key slots 768 have ramps 769. If stamping methods are used, a ramp 769 is formed by bending one edge of the key slot 768. The ramps 769 are located on the leading edge of the key slot 768. For example, the upper rotating plate 748 in FIG. 19B rotates counter-clockwise. The ramps 769 assist in closing the void immediately in front of the lug. The ramps 769 help prevent jamming.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A grinding mechanism for a food waste disposer, said grinding mechanism enclosed in a housing of the food waste disposer, said grinding mechanism comprising:

a shredder plate assembly including an upper rotating plate and a lower lug support plate, said lower lug support plate having a body portion and at least one fixed shredder lug integrally formed with said body portion, said upper rotating plate having at least one key slot for receiving said at least one fixed shredder lug;

a stationary shredder ring fixed to the housing of the food waste disposer, said stationary shredder ring having a plurality of teeth, said at least one fixed shredder lug capable of forcing food waste against the teeth of said stationary shredder ring to grind said food waste into particulate matter.

2. The grinding mechanism of claim 1, wherein said lower support plate further includes at least one fixed tumbling spike integrally formed with said body portion to assist in the movement of said food waste, said upper rotating plate having at least one key hole to receive said at least one fixed tumbling spike.

3. The grinding mechanism of claim 1, wherein said lower support plate further includes a strengthening rib.

4. The grinding mechanism of claim 1, wherein said lower support plate further includes a plurality of positive locators integrally formed with said body portion, said upper rotating plate having a plurality of key holes to receive said plurality of positive locators.

5. The grinding mechanism of claim 1, wherein said at least one shredder lug of said lower support plate includes a vertical toe, a notch and a heel, said heel having a slope, said lower support plate having a center, said slope of the heel decreasing inwardly toward the center of the lower lug support plate.

6. The grinding mechanism of claim 1, wherein said lower support plate is made from stamped metal.

7. The grinding mechanism of claim 1, wherein said upper rotating plate includes at least one strengthening rib and a plurality of drain holes located within said strengthening rib.

8. The grinding mechanism of claim 1, wherein said upper rotating plate is made from stamped metal.

9. The grinding mechanism of claim 1, wherein said at least one key slot has at least one edge formed as a ramp.

10. The grinding mechanism of claim 1, wherein said stationary shredder ring is made from stamped metal, said stationary shredder ring attached at a junction using a TOX® round joint.

11. The grinding mechanism of claim 1, wherein said stationary shredder ring includes a plurality of diverters and a plurality of breakers.

12. A food waste disposer, comprising:

an upper food conveying section including a first housing forming an inlet for receiving food waste;

a lower motor section including a motor for imparting rotational movement to a motor shaft; and a central grinding section disposed between said food conveying section and said motor section, said food conveying section conveying said food waste to said grinding section, said grinding section having a second housing, a shredder plate assembly and a stationary shredder ring, said shredder plate assembly mounted to said motor shaft, said shredder plate assembly having an upper rotating plate and a lower lug support plate, said stationary shredder ring having a plurality of teeth, said stationary shredder ring attached to the second housing, said lower lug support plate having a plurality of fixed shredder lugs to force said food waste against the teeth of said stationary shredder ring to grind said food waste into particulate matter.

13. The disposer of claim 12, wherein said lower support plate further includes a at least one tumbling spike to assist in the movement of said food waste, said upper rotating plate having at least one key hole.

14. The disposer of claim 12, wherein said lower support plate further includes a strengthening rib.

15. The disposer of claim 12, wherein said lower support plate further includes a plurality of positive locators, said upper rotating plate having a plurality of key holes to receive said plurality of positive locators.

16. The disposer of claim 12, wherein said shredder lugs of said lower support plate includes a vertical toe, a notch and a heel, said heel having a slope, said lower support plate having a center, said slope of the heel decreasing inwardly toward the center of the lower lug support plate.

17. The disposer of claim 12, wherein said lower support plate is made from stamped metal.

18. The disposer of claim 12, wherein said upper rotating plate includes at least one strengthening rib and a plurality of drain holes located with said strengthening rib.

19. The disposer of claim wherein said upper rotating plate is made from stamped metal.

20. The disposer of claim 12, wherein said upper rotating plate includes a plurality of key slots having more than one edge for receiving said shredder lugs, at least one edge of said key slots formed as a ramp.

21. The disposer of claim 12, wherein said stationary shredder ring is made from stamped metal, said stationary shredder ring attached at a junction using a TOX® round joint.

22. The disposer of claim 12, wherein said stationary shredder ring includes a plurality of diverters and a plurality of breakers.

23. The disposer of claim 12, wherein said second housing forms a discharge outlet having a threaded outer surface adapted to threadably engage a threaded inner surface of a plumbing nut used to connect a tailpipe to said discharge outlet.

24. The disposer of claim 12, wherein said first housing has a dishwasher inlet and a pair of substantially rounded diverters, said substantially rounded diverters located adjacent to the dishwasher inlet.

25. A grinding mechanism for a food waste disposer, said grinding mechanism enclosed in a housing of the food waste disposer, said grinding mechanism comprising:

a shredder plate assembly including an upper rotating plate and a lower lug support plate, said lower lug support plate having a body portion and at least one fixed shredder lug integrally formed with said body portion, said upper rotating plate having at least one key slot for receiving said at least one fixed shredder lug;

a stationary shredder ring fixed to the housing of the food waste disposer, said stationary shredder ring having a plurality of teeth, said at least one fixed shredder lug capable of forcing food waste against the teeth of said stationary shredder ring to grind said food waste into particulate matter;

wherein said lower support plate further includes a plurality of pumping fingers.

26. The grinding mechanism of claim 25, wherein said lower support plate further includes at least one fixed tumbling spike integrally formed with said body portion to assist in the movement of said food waste, said upper rotating plate having at least one key hole to receive said at least one fixed tumbling spike.

27. The grinding mechanism of claim 25, wherein said lower support plate further includes a strengthening rib.

28. The grinding mechanism of claim 25, wherein said lower support plate further includes a plurality of positive locators integrally formed with said body portion, said upper rotating plate having a plurality of key holes to receive said plurality of positive locators.

29. The grinding mechanism of claim 25, wherein said at least one shredder lug of said lower support plate includes a vertical toe, a notch and a heel, said heel having a slope, said lower support plate having a center, said slope of the heel decreasing inwardly toward the center of the lower lug support plate.

30. The grinding mechanism of claim 25, wherein said upper rotating plate includes at least one strengthening rib and a plurality of drain holes located within said strengthening rib.

31. The grinding mechanism of claim 25, wherein said lower support plate is made from stamped metal.

32. The grinding mechanism of claim 25, wherein said at least one key slot has at least one edge formed as a ramp.

33. A grinding mechanism for a food waste disposer, said grinding mechanism enclosed in a housing of the food waste disposer, said grinding mechanism comprising:

a shredder plate assembly including an upper rotating plate and a lower lug support plate, said lower lug support plate having a body portion and at least one fixed shredder lug integrally formed with said body portion, said upper rotating plate having at least one key slot for receiving said at least one fixed shredder lug;

a stationary shredder ring fixed to the housing of the food waste disposer, said stationary shredder ring having a plurality of teeth, said at least one fixed shredder lug capable of forcing food waste against the teeth of said stationary shredder ring to grind said food waste into particulate matter;

wherein said upper rotating plate includes a plurality of under-cutters.

34. The grinding mechanism of claim 33, wherein said lower support plate further includes at least one fixed tumbling spike integrally formed with said body portion to assist in the movement of said food waste, said upper rotating plate having at least one key hole to receive said at least one fixed tumbling spike.

35. The grinding mechanism of claim 33, wherein said lower support plate further includes a strengthening rib.

36. The grinding mechanism of claim 33, wherein said lower support plate further includes a plurality of positive locators integrally formed with said body portion, said upper rotating plate having a plurality of key holes to receive said plurality of positive locators.

37. The grinding mechanism of claim 33, wherein said at least one shredder lug of said lower support plate includes a vertical toe, a notch and a heel, said heel having a slope, said lower support plate having a center, said slope of the heel decreasing inwardly toward the center of the lower lug support plate.

38. The grinding mechanism of claim 33, wherein said upper rotating plate includes at least one strengthening rib and a plurality of drain holes located within said strengthening rib.

39. The grinding mechanism of claim 33, wherein said lower support plate is made from stamped metal.

40. The grinding mechanism of claim 33, wherein said at least one key slot has at least one edge formed as a ramp.

41. A food waste disposer, comprising:

an upper food conveying section including a first housing forming an inlet for receiving food waste;

a lower motor section including a motor for imparting rotational movement to a motor shaft; and a central grinding section disposed between said food conveying section and said motor section, said food conveying section conveying said food waste to said grinding section, said grinding section having a second housing, a shredder plate assembly and a stationary shredder ring, said shredder plate assembly mounted to said motor shaft, said shredder plate assembly having an upper rotating plate and a lower lug support plate, said stationary shredder ring having a plurality of teeth, said stationary shredder ring attached to the second housing, said lower lug support plate having a plurality of fixed shredder lugs to force said food waste against the teeth of said stationary shredder ring to grind said food waste into particulate matter;

wherein said lower support plate further includes a plurality of pumping fingers.

42. The disposer of claim 41, wherein said lower support plate further includes a at least one tumbling spike to assist in the movement of said food waste, said upper rotating plate having at least one key hole.

43. The disposer of claim 41, wherein said lower support plate further includes a strengthening rib.

44. The disposer of claim 41, wherein said lower support plate further includes a plurality of positive locators, said upper rotating plate having a plurality of key holes to receive said plurality of positive locators.

45. The disposer of claim 41, wherein said shredder lugs of said lower support plate includes a vertical toe, a notch and a heel, said heel having a slope, said lower support plate having a center, said slope of the heel decreasing inwardly toward the center of the lower lug support plate.

46. The disposer of claim 41, wherein said lower support plate is made from stamped metal.

47. The disposer of claim 41, wherein said upper rotating plate includes a plurality of key slots having more than one edge for receiving said shredder lugs, at least one edge of said key slots formed as a ramp.

48. A food waste disposer, comprising:

an upper food conveying section including a first housing forming an inlet for receiving food waste;

a lower motor section including a motor for imparting rotational movement to a motor shaft; and a central grinding section disposed between said food conveying section and said motor section, said food conveying section conveying said food waste to said grinding section, said grinding section having a second housing, a shredder plate assembly and a stationary shredder ring, said shredder plate assembly mounted to said motor shaft, said shredder plate assembly having an upper rotating plate and a lower lug support plate, said stationary shredder ring having a plurality of teeth, said stationary shredder ring attached to the second housing, said lower lug support plate having a plurality of fixed shredder lugs to force said food waste against the teeth of said stationary shredder ring to grind said food waste into particulate matter;

wherein said upper rotating plate includes a plurality of under-cutters.

49. The disposer of claim 48, wherein said lower support plate further includes a at least one tumbling spike to assist in the movement of said food waste, said upper rotating plate having at least one key hole.

50. The disposer of claim 48, wherein said lower support plate further includes a strengthening rib.

51. The disposer of claim 48, wherein said lower support plate further includes a plurality of positive locators, said upper rotating plate having a plurality of key holes to receive said plurality of positive locators.

52. The disposer of claim 48, wherein said shredder lugs of said lower support plate includes a vertical toe, a notch and a heel, said heel having a slope, said lower support plate having a center, said slope of the heel decreasing inwardly toward the center of the lower lug support plate.

53. The disposer of claim 48, wherein said lower support plate is made from stamped metal.

54. The disposer of claim 48, wherein said upper rotating plate includes a plurality of key slots having more than one edge for receiving said shredder lugs, at least one edge of said key slots formed as a ramp.

* * * * *